US009299215B2

(12) United States Patent
Gagner et al.

(10) Patent No.: US 9,299,215 B2
(45) Date of Patent: Mar. 29, 2016

(54) USING NON-WAGERING-GAME STATE FOR WAGERING GAMES

(71) Applicant: WMS Gaming, Inc., Waukegan, IL (US)

(72) Inventors: Mark B. Gagner, West Chicago, IL (US); Larry J. Pacey, Northbrook, IL (US); Danijel Stankovic, Evanston, IL (US); Jamie W. Vann, Chicago, IL (US); Matthew J. Ward, Northbrook, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 189 days.

(21) Appl. No.: 13/826,034

(22) Filed: Mar. 14, 2013

(65) Prior Publication Data

US 2013/0281189 A1 Oct. 24, 2013

Related U.S. Application Data

(60) Provisional application No. 61/635,420, filed on Apr. 19, 2012.

(51) Int. Cl.
*G07F 17/32* (2006.01)

(52) U.S. Cl.
CPC ..... *G07F 17/3227* (2013.01); *G07F 17/3225* (2013.01)

(58) Field of Classification Search
CPC ..... A63F 13/30; A63F 13/323; A63F 13/35; A63F 13/335; A63F 13/352; A63F 13/69; A63F 13/79; G07F 17/32; G07F 17/3225; G07F 17/3227
See application file for complete search history.

(56) References Cited

U.S. PATENT DOCUMENTS

| | | | | |
|---|---|---|---|---|
| 7,326,115 | B2 * | 2/2008 | Baerlocher | 463/25 |
| 8,475,265 | B2 | 7/2013 | Lafky et al. | |
| 2006/0079317 | A1 * | 4/2006 | Flemming et al. | 463/25 |
| 2006/0148548 | A1 * | 7/2006 | Hornik et al. | 463/16 |
| 2007/0259713 | A1 * | 11/2007 | Fiden et al. | 463/25 |
| 2008/0146322 | A1 * | 6/2008 | Hardy et al. | 463/25 |
| 2008/0146323 | A1 * | 6/2008 | Hardy et al. | 463/25 |
| 2008/0146345 | A1 * | 6/2008 | Hardy et al. | 463/42 |
| 2008/0200244 | A1 * | 8/2008 | Rowe et al. | 463/27 |
| 2008/0293478 | A1 * | 11/2008 | Anderson et al. | 463/25 |
| 2008/0300049 | A1 * | 12/2008 | Anderson et al. | 463/25 |
| 2009/0011823 | A1 * | 1/2009 | Englman et al. | 463/25 |
| 2009/0011824 | A1 * | 1/2009 | Englman et al. | 463/25 |

(Continued)

FOREIGN PATENT DOCUMENTS

WO WO 2010105088 A1 * 9/2010

*Primary Examiner* — Dmitry Suhol
*Assistant Examiner* — David Duffy
(74) *Attorney, Agent, or Firm* — DeLizio Law, PLLC

(57) ABSTRACT

A wagering game system and its operations are described herein. In some embodiments, the operations can include initiating a wagering game session and accessing a non-wagering game (e.g., a simulation social network game) during the wagering game session. The non-wagering game and wagering game can be associated with the same user. The operations can further include detecting a state (e.g., one or more virtual assets) of the non-wagering game. The operations can further include presenting the wagering game based on the state of the non-wagering game. For instance, the operations can select a type of wagering game content to present or modify a volatility of the wagering game based on the state of the non-wagering game.

25 Claims, 10 Drawing Sheets

(56) References Cited

U.S. PATENT DOCUMENTS

| | | | | |
|---|---|---|---|---|
| 2010/0062840 | A1* | 3/2010 | Herrmann | 463/25 |
| 2011/0003627 | A1 | 1/2011 | Nicely et al. | |
| 2013/0079088 | A1 | 3/2013 | Lafky et al. | |
| 2013/0079089 | A1 | 3/2013 | Lafky et al. | |
| 2013/0079108 | A1 | 3/2013 | Lafky et al. | |
| 2013/0079109 | A1 | 3/2013 | Lafky et al. | |
| 2013/0203478 | A1 | 8/2013 | Kennedy et al. | |
| 2013/0203489 | A1 | 8/2013 | Lyons | |
| 2013/0203490 | A1 | 8/2013 | Hilbert | |

* cited by examiner

705

BIG EVENT RESULTS

| PLAYER | CASH AWARD | VIRTUAL CURRENCY AWARD | OTHER AWARDS |
|---|---|---|---|
| STAN J. | 500 CREDITS | $200 | |
| BOB. S | 30 CREDITS | $25 | RED RUBY MONEY CLIP.<br><br>MULTIPLIER FACTOR +10 ON FREE SPIN TYPE GAMES FOR NEXT 60 MINUTES IF USED IN CURRENT CASINO WITH AN AVERAGE BET OF $0.50 PER MINUTE |
| HELEN G. | (NOT CURRENTLY ELIGIBLE FOR CASH AWARD) | $550 | 1 FREE SPIN OF SLOTS O' LUCK AT NEXT VISIT TO CASINO X. |
| JEAN S. | (NOT CURRENTLY ELIGIBLE FOR CASH AWARD) | $20 | INVITATION TO HIGH-ROLLER BLACK JACK TOURNAMENT AT CASINO Y ON 5/25. |

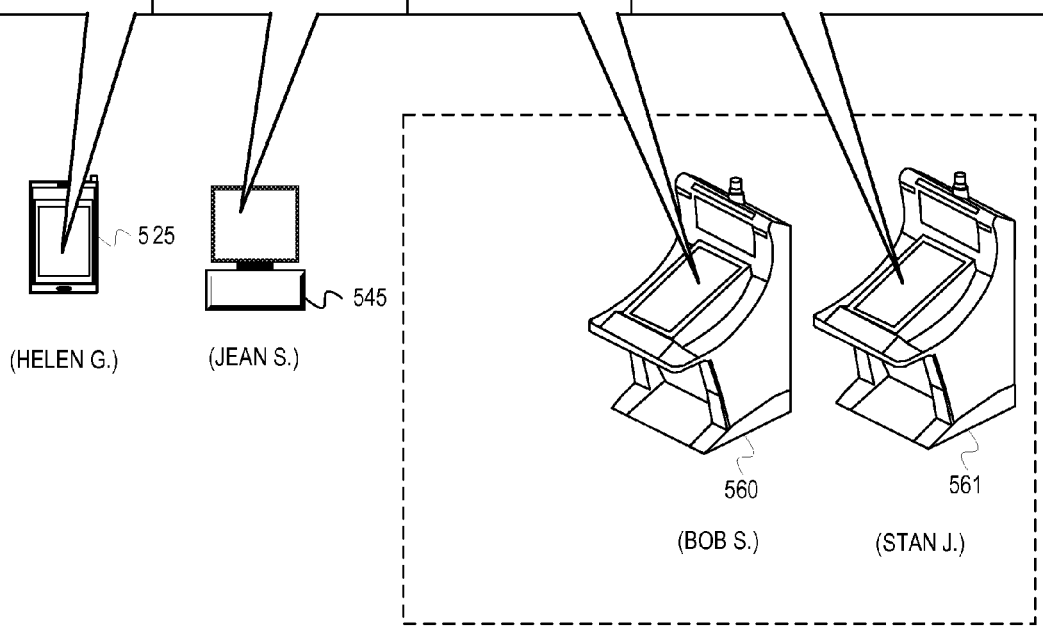

FIG. 7

USING NON-WAGERING-GAME STATE FOR WAGERING GAMES

RELATED APPLICATIONS

This application claims the priority benefit of U.S. Provisional Application Ser. No. 61/635,420 filed Apr. 19, 2012.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

TECHNICAL FIELD

Embodiments of the inventive subject matter relate generally to wagering game systems and networks that, more particularly, utilize non-wagering applications.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

Some wagering game providers have begun to recognize the entertainment value that non-wagering types of applications, such as non-wagering or "for fun" games can provide in conjunction with wagering games. Therefore, there is also a developing need for wagering game providers to generate interesting ways of enhancing a wagering game experience with non-wagering games.

BRIEF DESCRIPTION OF THE DRAWING(S)

Embodiments are illustrated in the Figures of the accompanying drawings in which:

FIG. 7 is an illustration of awarding cash and non-cash awards in a community gaming event, according to some embodiments;

DESCRIPTION OF ILLUSTRATIVE EMBODIMENTS

This description of the embodiments is divided into four sections. The first section provides an introduction to embodiments. The second section describes example operations performed by some embodiments while the third section describes example operating environments. The fourth section presents some general comments.

Introduction

This section provides an introduction to some embodiments.

Some embodiments of the inventive subject matter present a persistent-state, non-wagering game by which a player can attain a state (e.g., acquire one or more virtual assets) for the non-wagering game. Some embodiments utilize the state of the non-wagering game, such as virtual assets of the non-wagering game, to present a wagering game (e.g., select specific wagering game content to present, modify presentation of default wagering game content, adjust a volatility of a wagering game, etc.). For example, some embodiments select or present specific wagering game types, features or functionality based on characteristics of the state (e.g., virtual assets) of the non-wagering game. Some embodiments modify volatility, risk, math, etc. of wagering games based on the state of the non-wagering game. Further, some embodiments utilize the state to of one or more players associated with the non-wagering game to determine eligibility for community wagering game events.

In some embodiments a non-wagering game is a computer game that can be accessed via an online environment. For example, the non-wagering game can be a simulation social network game accessible via an online social network environment, such as via a website presentable via a web browser, a three-dimensional simulated environment, or other such environment. A player can attain progress in the non-wagering game, such as by building, expanding or managing some virtual assets within a fictional community or project with limited resources. In some embodiments the virtual assets are stored, or persisted, via use of a user account such as a social network user account for an online social network environment. The user account may also be referred to as a non-wagering game player account. The player can use the virtual assets from the non-wagering game to affect an associated wagering game, such as a casino-based game available in a brick-and-mortar casino or an online wagering game available via an online wagering game venue. The wagering game can, in turn, affect the state of the persistent-state, non-wagering game during a wagering game session so that the state of the non-wagering game is different when the player subsequently accesses the non-wagering game after the wagering game session (e.g., when the player leaves the casino-based environment or online gaming venue and subsequently accesses the non-wagering game online and/or via a social networking environment).

Figure 1:
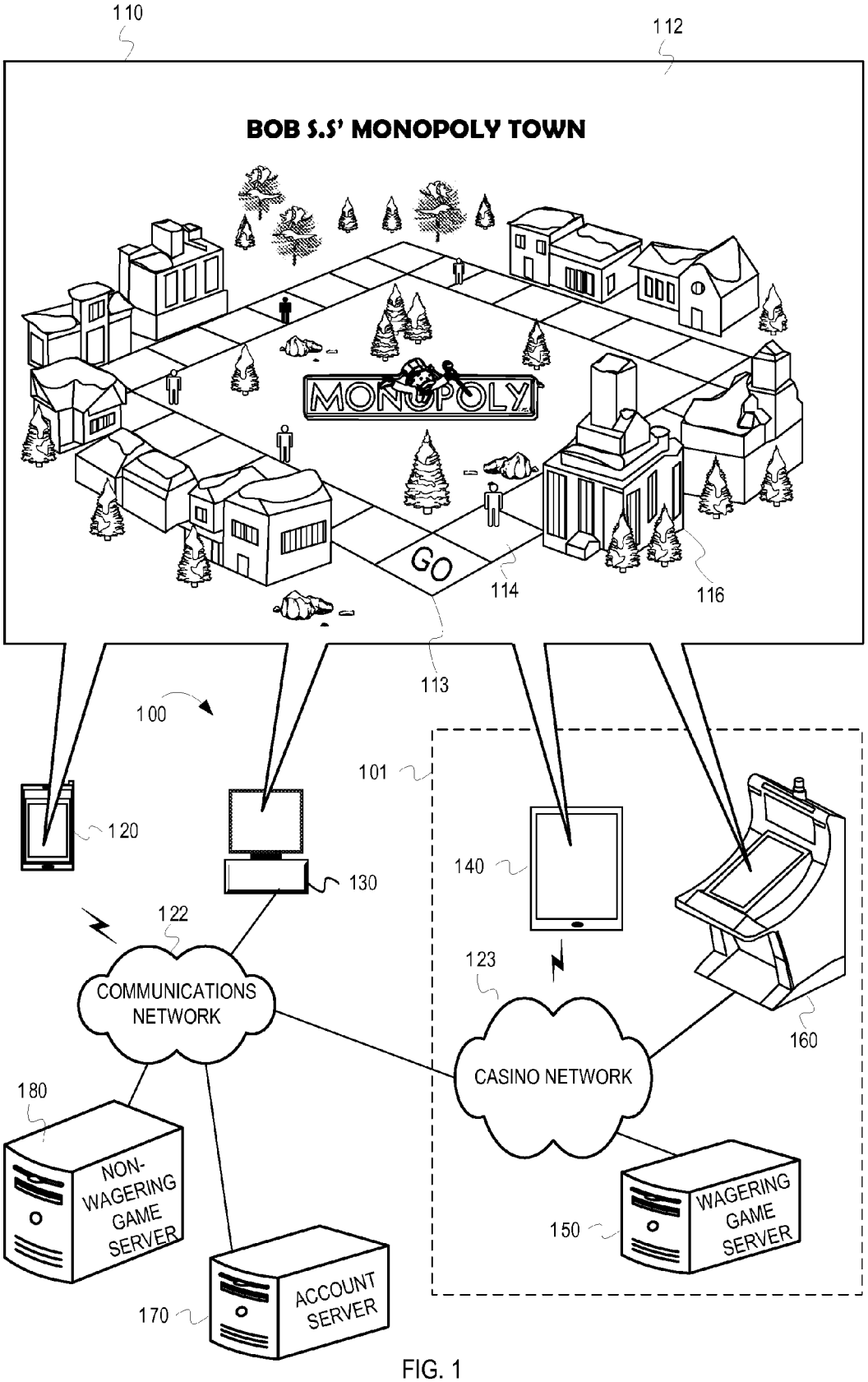
FIG. 1 is an illustration of presenting a persistent non-wagering simulation game, according to some embodiments.

FIG. 1 is a conceptual diagram that illustrates an example of presenting a persistent non-wagering simulation game, according to some embodiments. In FIG. 1, a wagering game system ("system") 100 includes one or more computing devices that present one or more non-wagering games. Examples of the one or more computing devices include a wagering game machine 160, a tablet computer 140, a personal computer 130, and a mobile device 120. Some of the devices can be in a casino 101 (e.g., the wagering game machine 160 and the tablet computer 140), while others of the computing devices can be outside of the casino 101 (e.g., the personal computer 130 and the mobile device 120). Any of the computing devices can access a non-wagering game 110, such as a social network game accessible via an online social network environment. The non-wagering game 110 is depicted in FIG. 1 as a three-dimensional simulated environment, such as a virtual world within which three-dimensional objects exist or in which avatars reside. An avatar is a graphical representation of a player that inhabits a virtual world. Other examples of the non-wagering game 110, however, include other types of game formats, such as two-dimensional graphical games, text based games, and so forth. The system 100 further includes a wagering game server 150 through which the tablet computer 140 and the wagering game machine 160 can obtain wagering game content, secondary applications, random number generation services, account information, and so forth. The system 100 further includes a non-wagering game server 180 via which games and other content, which are not wagering games, are provided to any of the computing devices. The computing devices can communicate with each other and/or with the servers (e.g., the non-wagering game server 180, the account server 170, and the wagering game server 150) via one or more communications networks, such as communications network 122 and/or a casino network 123. The communications network 122 may be a public network, such as the Internet, whereas the casino network 123 may be a private network.

In some embodiments, the system 100 can modify the presentation of the non-wagering game 110 based on the platform by which it is presented. For example, when the non-wagering game 110 is presented via the personal computer 130, the non-wagering game 110 can present objects that are clickable by a mouse. Whereas, when the non-wagering game 110 is presented via a device in a wagering game venue, such as via the wagering game machine 160, the non-wagering game 110 may be presented with objects to touch via a touch screen instead of being clickable by a mouse. In another example, if the non-wagering game 110 is presented via the mobile device 120, because of limited display size, the non-wagering game 110 may make extensive use of game menus to present textual representations of game features that normally would be presented graphically.

The account server 170 can include a non-wagering game player account for a player to use when accessing the non-wagering game 110 via the one or more computing devices. The account server 170, or other servers, such as a wagering game server 150, can include other types of player accounts, such as a wagering game player account by which a player can access wagering game content. In some embodiments, the non-wagering game player account and the wagering game player account are associated or linked together. The accounts may belong to the same individual, group of individuals, or entity. For instance, Bob S., a fictitious user/player presented as an example herein, may be assigned to the non-wagering game player account (e.g., Bob S. registered individually for the non-wagering game player account) and also may be assigned to the wagering game player account (e.g., Bob S. registered individually for the wagering game player account). In some embodiments, the non-wagering game account is shared by a group, or team, of players. The non-wagering game player account may be associated with (e.g., linked to) a wagering game player account that is assigned to at least one of the group members that share the non-wagering game player account. For example, Bob S. and Stan J. may share a non-wagering game player account. During a wagering game session, Bob S. logs in to a wagering game machine using his individual wagering game player account that is not shared with Stan J. The wagering game may access the shared non-wagering game player account via a link to Bob. S.'s wagering game player account. For brevity, many examples herein refer to one player associated with a non-wagering game player account, however, it should be understood that many, or all, of the same examples can refer to multiple players being associated with a non-wagering game player account. In yet other embodiments, a non-wagering game player account may be integrated with a wagering game player account (e.g., are the same account). When the account is used in a non-wagering game environment, a player can access non-wagering game content and when the account is used in a wagering-game environment a player can access wagering game content and non-wagering game content.

Via the system 100, a player (e.g., Bob S.) can access an instance of the non-wagering game 110 which pertains to a domain inside a virtual world that the pertains to the player and which the player can customize and build-up via play of the non-wagering game 110. The non-wagering game account can store progress in the non-wagering game 110 that is specific to the player (or players in the case of a shared non-wagering game player account) and persist objects or achievement associated with the non-wagering game 110.

An instance of the non-wagering game 110 that is customized to the player includes a state of one or more virtual assets that the player has earned or obtained. In some embodiments, the player obtains virtual assets via play of the non-wagering game 110. The player can play the non-wagering game 110 prior to, or concurrently with, a wagering game session. Via the non-wagering game 110, the player can obtain or acquire one or more virtual assets, increase a value of the one or more virtual assets, modify a state or property of one or more virtual assets, etc. In some embodiments, the non-wagering game 110 has an objective to acquire virtual assets, increase a value of virtual assets, and/or to modify a state or property of virtual assets. Virtual assets may include any type of object, or property of an object, that a player can obtain or modify via play of the non-wagering game 110. In some examples, virtual assets can be stored within a profile or inventory specific to the player ("player inventory"). The virtual assets can persist in a player inventory beyond a single game session. Some examples of virtual assets may include virtual real estate, virtual awards, virtual tokens, virtual game pieces, virtual currency, etc. The system 100 presents a virtual game board 113, or other playing area, that shows the player's progress in the non-wagering game 110, such as a number of virtual real-estate properties that have been acquired, an amount of money held in a bank, etc. Some examples of virtual assets for a real-estate type of game (e.g., a Monopoly® game) includes objects or properties associated with (1) a specific location (e.g., a "town") or type of location (e.g., a "forest town" or a "winter town") within a virtual world (e.g., Bob S.'s Monopoly® Town 112), (2) a virtual real-estate property 114 (e.g., a version of Monopoly® Boardwalk or Park Place), (3) a structure 116 on a virtual real-estate property (e.g., a hotel or house that increases the value of a virtual real-estate property), (4) a virtual company (e.g., a utility company, a railroad company, etc.), (5) a virtual game card (e.g., a Community chest card, a Chance card), (6) virtual currency in the player's inventory (e.g., Monopoly® money, virtual cash, virtual credit, etc.), (7) a specific game piece (e.g., a top hat, a car, etc.), (8) a game character or avatar associated with a player (e.g., Mr. Monopoly®, a pet avatar, etc.), and so forth. Other types of game themes can utilize other forms of virtual assets (e.g., a game theme based on a movie or book may include virtual assets that represent objects or characters in the movie or book, a game theme based on an individual may include virtual assets that represent characteristics or possessions of the individual, etc.).

In some embodiments, virtual assets can be obtained via play or actions within the non-wagering game 110. For example, within the non-wagering game 110 a player can obtain/use virtual currency required to acquire other virtual assets of the game (e.g., in Monopoly®, a player can earn Monopoly® money, which the player can use to buy, and/or increase a value of, a virtual real-estate property according to the rules of the game). In some embodiments, a player can buy virtual currency using actual currency (e.g., via credit card). In some embodiments, the non-wagering game 110 utilizes actual currency to purchase virtual assets in addition to, or instead of, virtual currency. In some embodiments, the system 100 provides a feature to buy game pieces for placement on the virtual game board 113. In some embodiments, the game pieces can grant rights to obtain virtual real-estate property or other such virtual assets.

In some embodiments, virtual assets can be obtained as a gift or loan from another player. For example, a first player of the non-wagering game 110 can gift or lend a second player of the non-wagering game 110 a specific virtual asset. The second player holds the virtual asset and can, at some point, return the virtual asset to the first player.

In some embodiments, virtual assets can be obtained via play or actions within a wagering game or wagering-game venue. For example, a player (e.g., Bob S.) may initiate a wagering game session via the wagering game machine 160. The wagering game machine 160 may integrate with the non-wagering game 110 and present one or more portions of the non-wagering game, and its virtual assets, as part of the wagering game. For instance, wins or accomplishments in the wagering game can award non-wagering game virtual assets. In some embodiments, the wagering game can provide non-wagering game currency to obtain additional virtual assets. In some embodiments, specific virtual assets can only be obtained via play or actions associated with a wagering game.

During a wagering game session, the system 100 can link a wagering game player account, associated with the wagering game, to a non-wagering game player account, associated with the non-wagering game, via unique identifiers associated with wagering game player account and the non-wagering game player account. The system 100 can access virtual assets from the non-wagering game player account, via the linked accounts, and use the virtual assets during the wagering game session. The system 100 can use the virtual assets in the wagering game in various ways. For example, the existence of a virtual asset in the non-wagering game 110 can affect a wagering game in ways that do not affect the wagering game math, outcomes, or award values, but do influence other aspects of the wagering games, such as types of wagering game content to present (e.g., theme types, bonus game types, primary game types, etc.), a duration of wagering games or specific wagering game functionality, a number or amount of wagering game elements, objects, awards, objectives, etc. In some embodiments, the existence of a virtual asset in the non-wagering game 110 can affect wagering game rules, chances of winning, or monetary value of awards. In some embodiments, the existence of a virtual asset can affect the volatility of a wagering game's payout or awards. In some embodiments, the system 100 can provide controls and options within a wagering game to access and control the non-wagering game 110. For example, the system 100 can present controls that a player can use to buy certain virtual assets in the non-wagering game, during a wagering game session. A player may purchase the virtual assets during the wagering game session based on a belief that the virtual assets may improve the chances of winning more in the wagering game.

In some embodiments, the non-wagering game 110 is offered on a mobile device that the player can carry around one or more portions of the casino (e.g., via the tablet computer 140). In some embodiments, when the non-wagering game 110 is played within the casino, the system 100 makes the player eligible to participate in casino activities, such as sweepstakes, jackpots, community events, etc. As an example, when the player is playing on mobile device, the player may purchase a virtual asset via the non-wagering game 110, which virtual asset has an expiration period, such as five minutes. For a certain time period thereafter, the player is eligible to participate in a community event if a bonus round occurs before the virtual asset expires. In some embodiments, the bonus round can be presented on the mobile device carried by the player within the casino.

Further, some embodiments of the inventive subject matter describe examples of using non-wagering game virtual assets in wagering games in a network wagering venue (e.g., an online casino, a wagering game website, a wagering network, etc.) using a communication network, such as the communications network 122 in FIG. 1. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account.

Therefore, for brevity, to avoid having to describe the interconnection between player and player account in every instance, a "player account" may be referred to herein in either context. Further, in some embodiments herein, the word "gaming" is used interchangeably with "gambling."

Although FIG. 1 describes some embodiments, the following sections describe many other features and embodiments.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 2:
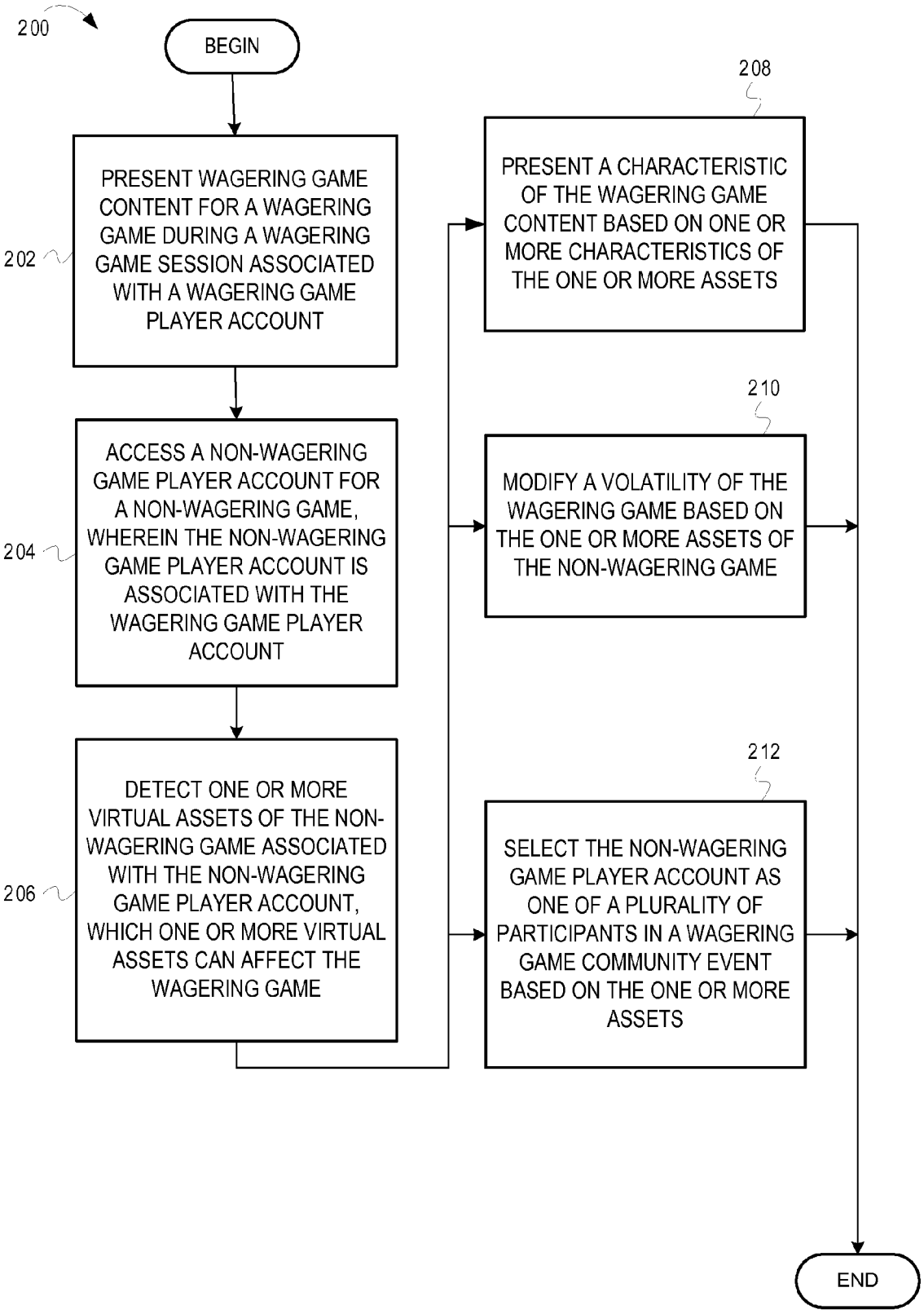
FIG. 2 is a flow diagram 200 illustrating using a non-wagering game virtual asset in a wagering game, according to some embodiments.

FIG. 2 is a flow diagram ("flow") 200 illustrating using a non-wagering game virtual asset in a wagering game, according to some embodiments. FIGS. 2-5, 6A-6B, and 7 are conceptual diagrams that help illustrate the flow of FIG. 2, according to some embodiments. This description will present FIG. 2 in concert with FIGS. 2-5, 6A-6B, and 7. In FIG. 2, the flow 200 begins at processing block 202, where a wagering game system ("system") presents wagering game content for a wagering game during a wagering game session associated with a wagering game player account. For example, the system may present a wagering game via a wagering game machine within a casino in response to a player logging in to the wagering game machine using a wagering game player account and/or by specifying an amount of money to use during the wagering game session.

The flow 200 continues at processing block 204, where the system accesses a non-wagering game player account for a non-wagering game, wherein the non-wagering game player account is associated with the wagering game player account. For instance, either before or during the wagering game session begins, the system can access a non-wagering game player account for the non-wagering game. FIG. 1 above described one example of a non-wagering game that is customized for a player and which is accessible via one or more computing devices in combination or independently, concurrently in time or at different times, by either one player or different players.

The flow 200 continues at processing block 206, where the system detects one or more virtual assets of the non-wagering game associated with the non-wagering game player account, which one or more virtual assets can affect the wagering game. For example, information related to the one or more virtual assets are stored in a memory or data store associated with the non-wagering game player account, such as in a player inventory, a player profile, a player database record(s), a configuration file, etc. that are related to the non-wagering game player account. In some embodiments, the one or more virtual assets belong to an additional non-wagering game player account that is associated with the non-wagering game player account as a social contact. After processing block 206, the flow continues in a branch fashion where operations for any one, or any combination of, processing blocks 208, 210, and 212 can occur independently (e.g., exclusive of each other) and/or in parallel. The operations of processing blocks 208, 210, and 212 more generally refer to some specific ways that characteristics or properties of the one or more virtual assets can affect, or modify, the wagering game.

The description of flow 200 continues at processing block 208, where the system presents a characteristic of the wagering game content based on one or more characteristics of the one or more virtual assets. In some embodiments, existence of a virtual asset in the non-wagering game can affect a wagering game in ways that do not affect the wagering game math, outcomes, or award values, but do influence other aspects of the wagering games. For instance, the system can utilize the virtual asset to affect an appearance or presentation mechanics of a wagering game so that outcomes of the wagering game look like they were affected by the virtual asset even though the virtual asset did not actually affect the outcome. For example, the system can determine an amount that a wagering game is going to award to a player and, before revealing the amount, the system can present a message that indicates that the virtual asset affected the amount of the award. For instance, the system may decide to award 50 credits in a bonus game, but may determine that the player has several Monopoly® railroads and the system presents a message via a display of the wagering game machine that says, "Railroads are worth double, you won 50 credits." However, the system is merely utilizing the player's non-wagering game virtual assets to manipulate the presentation of the wagering game outcomes in a way that looks like the non-wagering game virtual assets affected the outcome, even if they did not. In another example, because of the existence of a virtual asset, a wagering game may present a likeness of the virtual asset while presenting the wagering game content, such as presenting a likeness of the virtual asset as slot reel symbol. In some embodiments, the system uses a likeness of a character associated with the virtual asset when presenting wagering game content. In some embodiments, the system adapts the wagering game content to match or be similar to a property of a virtual asset (e.g., match a color, texture, theme, feature, action, etc. of the virtual asset).

In some embodiments, the characteristics or properties of a virtual asset may cause a selection of a specific type of wagering game experience. For instance, an existence of a virtual asset causes the system to select a specific type of bonus game, type of feature, etc. For example, when the player is playing a primary wagering game, such as via a wagering game machine in a casino, the primary wagering game may trigger a bonus. However, the primary wagering game may have a variety of types of bonus content to present. Based on the player's ownership of a certain virtual asset, the system selects one of the types of the bonus content to present. For example, in a Monopoly® game, red houses may cause the occurrence of either a "picking" type of bonus or a "free-spin" type of bonus in the wagering game, but a green house will cause a "mystery event" type of bonus. In another example, virtual assets or virtual currency in the player's inventory for the non-wagering game can be spent to purchase a type of bonus game, or in other words, to purchase a virtual asset that will ensure that a type of bonus game will be selected during a subsequent wagering game session. In some embodiments, a wagering game may have a setting that indicates a default type of gaming experience that the wagering game would normally present. However, when the system determines the existence of the virtual asset (i.e., when the system determines that the non-wagering game player account is in possession of the virtual asset), the system uses a different setting that is not the default setting. The different setting will cause the presentation of the wagering game content to be different from a default presentation that would occur. For instance, a wagering game's default setting may be to present a free-spin type of bonus. However, if the player (via the non-wagering player account) possesses a virtual asset with a characteristics that indicates that a picking type of bonus game should be presented instead, then then the system can use a different wagering game setting that will instead present the picking type of bonus game in accordance with the characteristic of the virtual asset that indicates that the picking type of bonus game should be presented. In some embodiments, a default setting may be to randomly select from a variety of types of wagering game experiences. However, the characteristics of a virtual asset can influence, or weight, the chances of the wagering game being one of the types over others of the types. For example, if a wagering game has a default setting to randomly select either a free-spin type of bonus game or a picking type of bonus game, but the virtual asset indicates a property value that indicates a preference, or weight, towards the picking type of bonus game, then the system can more heavily weight the chances of the random selection more toward a picking type of bonus game than toward the free-spin type of bonus game.

Figure 3:
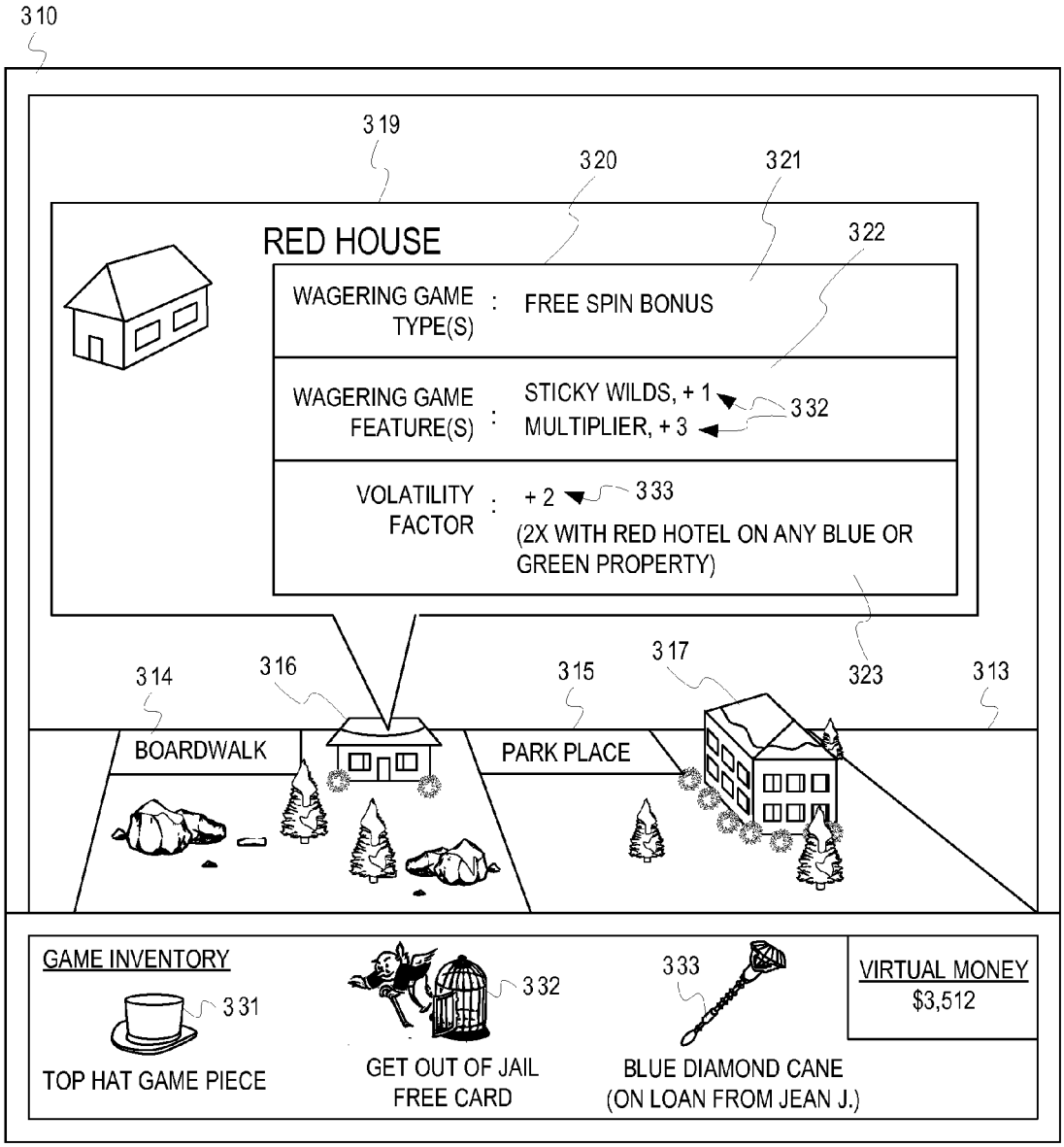
FIG. 3 is an illustration of presenting a non-wagering game with virtual assets that can affect a wagering game, according to some embodiments.

FIG. 3 is an illustration of presenting a non-wagering game with virtual assets that can affect a wagering game, according to some embodiments. In FIG. 3, a non-wagering game 310 is presented, similar to the non-wagering game 110 described in FIG. 1. Virtual real-estate properties 314 and 315 can include one or more game objects, such as a red house 316 or a red hotel 317. The virtual real estate properties 314 and 315 and the game objects, such as the red house 316 and the red hotel 317, are virtual objects attained or earned by a player in the non-wagering game 310. When one of the virtual assets is selected, such as the red house 316, a menu 319 is presented that describes some characteristics 320 of the red house 316. The characteristics 320 of the house 319 are specific characteristics that indicate how the existence of the red house 316 within a non-wagering game player account (e.g., how the possession or attainment of the red house 316 by the player of the non-wagering game 310), can potentially affect a wagering game experience during a wagering game session that the player may participate in. A first characteristic 321 describes a type of wagering game bonus that will be selected, or that is more likely to be selected, during a wagering game session based on the red house 316 being on the virtual real-estate property 314. In some embodiments, a player may purchase the red house 316 and place it on the virtual real-estate property 314 to indicate a preference for the first characteristic 321. For instance, instead of placing a blue house on the virtual real-estate property 314, the player selects the red house 316 because of a preference for the type of bonus wagering game (i.e., the "free spin" type of bonus) indicated by the first characteristics 321. In some embodiments, the player can change the first characteristic 321 to another type based on preference, by paying virtual money, by attaining a level of achievement in the non-wagering game, by attaining an achievement in a wagering game, or in other ways.

Returning to the description of the flow 200 of FIG. 2 as it relates to processing block 208, in some embodiments, a virtual asset can affect a number or degree of bonus game objects, an amount of activities to present or perform, etc. For example, the existence of the virtual asset affects a number of free spins or a number of free picks offered in the bonus game. In one example, if the virtual asset is a house, then a first number of free spins are available, but if the virtual asset is a hotel, then a second number of free spins are available which is higher or lower than the first number of free spins. In another example, an existence of a virtual asset determines a secondary feature of a bonus game to present in addition to primary bonus feature. For instance, a virtual asset that is a house offers a certain number of free spins (i.e., the primary bonus feature) with a random multiplier (e.g., a first type of secondary bonus feature), but a virtual asset that is a hotel offers the same primary bonus feature with sticky wilds (e.g., a second type of secondary bonus feature), whereas a virtual asset that is a railroad offers the same primary bonus feature but with a number of wild reels (e.g., a third type of secondary bonus feature), where the number of wild reels depends on the number of railroads that have been attained. In one example, the system chooses an add-on, or secondary feature, based on a combination of virtual assets. For example, when a wagering game bonus reveals a number of free spins, the system determines that a number of virtual assets affect a multiplier value, or at least a presentation of a multiplier value, that may multiply any awards from the free spins. For instance, a 10× multiplier is selected prior to the free spins, but the game presents a plurality of non-wagering game virtual assets that add up to the chosen 10× multiplier (e.g., a "5×" multiplier value assigned to virtual asset that is a house, plus a "3×" multiplier value assigned to a virtual assets that is Mr. Monopoly®, plus a "2×" multiplier value assigned to a virtual asset that is a top hat, which values add up to the chosen "10×" multiplier). Referring again to FIG. 3, the red house 316 may have a second characteristic 322 that indicates one or more types of secondary game features available in a bonus game (e.g., "sticky wilds" or "multiplier" features) as well as assigned modification values (e.g., the sticky wilds feature has a modification value of "+1" and the multiplier feature has a modification value of "+3"). The system can utilize the modification values to determine a degree of modification (e.g., increase or decrease) from a default presentation value. For example, one type of default presentation value may be related to a degree of likelihood that the bonus game will present a sticky wild or a multiplier (e.g., the bonus game may have a default likelihood, or chance, of 10% that the secondary features will occur within the bonus) or an amount associated with the secondary feature (e.g., the bonus game may have a default multiplier of "3×"). The modification values, if positive, increase the percentage of likelihood that the secondary features will occur by an amount proportional to the modification value. For instance, the likelihood of the secondary feature occurring increases by 5% for each positive integer value increment of the modification value. Thus, if the sticky wild has a default 10% chance of occurring, because the modification value for the sticky wild feature is indicated as "+1" according to the second characteristic 322, then during a bonus game, the chance that that the sticky wild will occur increases to 15%. In another example, the secondary feature amount may increase by a given multiplication factor based on the modification value. Thus, if a multiplier has a default value of "3×," and if the given factor for the multiplier increase is a "1×" increase per each positive integer value, then a modification value of "+3" for the multiplier feature indicated in the second characteristic 322 would increase the default value of "3×" to "6×."

Returning to the description of the flow 200 of FIG. 2 as it relates to processing block 208, in another example, a virtual asset from the non-wagering game, such as a type of game piece, can determine another character or object or virtual asset (e.g., a cross-over object) from the non-wagering game that will be involved in a presentation (e.g. a reveal of) a wagering game item, feature, activity, etc. For instance, during a bonus spin, with a multiplier, the multiplier can be revealed in one of many ways depending on the associated virtual asset or virtual assets that were selected. For example, if the system selects a specific virtual real-estate property (e.g., Boardwalk), but the player also owns a specific other property (e.g., a railroad, a shoe store, etc.) or a specific game piece (e.g., a game piece that wears formal wear), then the system can reveal the multiplier using an object that looks like an item from the other virtual real-estate property or specific game piece (e.g., a train rolls by during a spin to reveal a multiplier, Ms. Monopoly® walks out with a number of shoe boxes to reveal the multiplier, Mr. Monopoly® walks out and tips his top hat to reveal the multiplier, etc.). The appearance of the objects associated with the other virtual real-estate property and/or specific game piece may be referred to as cross-over effects.

Some virtual assets from the non-wagering game can evolve or mature (e.g., a hotel adds an extra floor), which maturation can modify or enhance the affect that the virtual asset has on a wagering game. Some virtual assets can become available or mature only via wagering game play or casino activity, where other virtual assets can become available or mature via wagering game play or non-wagering game play.

The description of flow 200 continues at processing block 210, where the system modifies a volatility of the wagering game based on the one or more virtual assets of the non-wagering game. In some embodiments, the system can determine a range of potential payout values associated with an average payout for the wagering game. The system can also determine one or more volatility modification values associated with the one or more virtual assets. The system can increase the range of potential payout values in accordance with the one or more volatility modification values. For instance, the system can increase a high-end value and decrease a low-end value of the potential payout values proportional to the one or more volatility modification values. In one example, such as for a bonus game that pays out based on a multiplier, the system can increase a high-end multiplier value of a bonus game award and decrease a low-end multiplier value of a bonus game award proportional to the one or more volatility modification values. In an example where a bonus game pays out based on a number of picking items that are selected, the system can increase a high-end bonus award for at least one of a number of picking items in a picking bonus game and decrease a low-end bonus award of at least one of the number of picking items in the picking bonus game proportional to the one or more volatility modification values.

Regarding how a virtual asset may affect wagering game volatility, in some embodiments, a wagering game may be programmed to have an average random payout, such as 5× a player's bet, although the payout may range between 3× to 10×, where the likelihood of the value of higher actual payouts is much less than the likelihood of lower actual payouts. However, a virtual asset may increase the volatility to a higher value, such as up to 25×, but may also lower the potential payout range down to 1×, which provides the possibility of getting a higher payout even if the likelihood of getting the 25× is low. The likelihood of the high-end payout occurring, again, is still much less than the likelihood of the low-end occurring. Therefore, the average payout for the wagering game can still be 5×, but the volatility range is now different. In some embodiments, the system can filter the volatility range so that the chances of the payout are only 1×-2× or 25×. Nevertheless, the virtual asset at least allows the opportunity for the player to have a potentially higher bonus payout. In other words, an average award for a wagering game can remains as it is programmed to be, but, based on the virtual assets that the player possesses the fluctuations of the award amounts, either higher or lower than average, increases (i.e., the "volatility" of award values increases). By modifying the volatility range, the player has a chance of winning more without affecting the overall average payouts of the wagering games. The same concept applies to a feature that ultimately can affect the payout, such as a multiplier (e.g., the "5×" "3×" "10×" "1×" "2×" and "25×" values mentioned above may apply to the amounts for multipliers in a wagering game). The volatility of the likely bet multiplier, which affects the payout, can be based on the virtual asset. In other examples, such as a picking game, the volatility can be based on an amount behind any given picking element. For example, a volatility of "0" for a picking game could mean that the all the same amounts are behind each of the picking elements (e.g., of 5 picking elements, they all have a value of 3 credits). As the volatility increases, the amounts behind the picking elements become more different from each other (e.g., an example of a picking game with some volatility would be that for a picking game with 5 picking elements, one may have a hidden value of 9 credits, two have a hidden value of 3 credits, and two have a hidden value of 0 credits).

In some embodiments, the characteristics (e.g., properties, behaviors, etc.) of the virtual asset may correspond to a degree of volatility that the virtual asset provides. For example, graphical characteristics of virtual assets may visually indicate volatility properties, such as a degree of terrain of a virtual-real estate property (e.g., the more rocky a terrain, the more the virtual-real estate property would affect wagering game volatility), a texture of an object (e.g., the more rough a texture, the more volatility the object provides), a shade of color (e.g., the more red an object is, the more volatility the object provides), and so forth. Textual, audible, or other characteristics may also indicate degrees of volatility. Some virtual assets can be enhanced with volatility. For example, if a player wishes to improve the volatility of a virtual real-estate property, and, if according to the non-wagering game rules red houses increase volatility when associated with (e.g., placed on) a virtual-real estate virtual asset, the player can purchase one or more red houses for that virtual real-estate property.

Some virtual assets may guarantee a specific volatility or volatility range (e.g., some virtual assets guarantee an average/5× multiplier, some virtual assets guarantee a range of 4×-8× multiplier, etc.).

In some embodiments, the system can utilize a combination of virtual assets to affect volatility. For example, the system can access a plurality of tables associated with the one or more virtual assets of the non-wagering game. Each of the plurality of tables may include at least one volatility modification value. The system can combine the at least one volatility modification value from each of the plurality of tables, and modify the volatility of the wagering game based on a result of the combining of the at least one volatility modification value from each of the plurality of tables. Each of the virtual assets can have a plurality of tables attached to it, where each of the tables affects characteristics of different types of game characteristic or feature (e.g., different game themes, different denominations, different game functionality, etc.). For example, one table for one virtual asset may apply to a "free spin" type of bonus game, while another table of the same virtual asset may apply to a "picking" type of bonus game, and yet another table for the same virtual asset may apply to a "mystery" type bonus game, and so forth for the different types of different bonus games. The system can randomly select from one or more of the virtual assets in the non-wagering game and use the particular table(s) for the randomly selected virtual asset(s) that correspond(s) to a particular type of gaming characteristic associated with the wagering game. In some embodiments, the system can search through virtual assets to find one with a table that applies to a specific wagering game characteristic (e.g., feature, behavior, etc.), and (1) select the specific wagering game characteristics because the table exists, (2) use the table to affect wagering game mechanics or presentation, (3) use the table for the specific wagering game feature to determine volatility parameters, and so forth.

Figure 4:
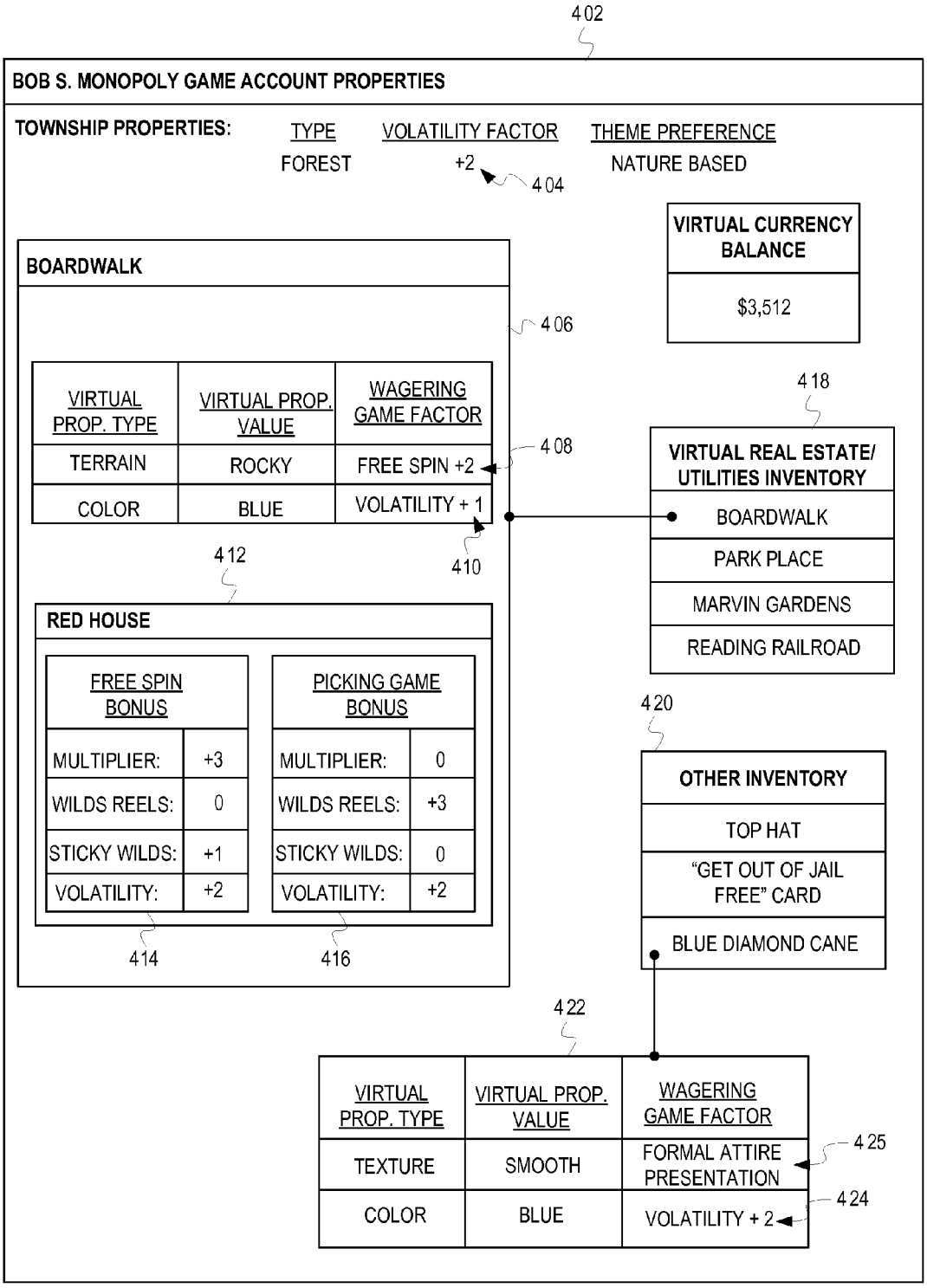
FIG. 4 is an illustration of accessing virtual asset values of a non-wagering game, according to some embodiments.

FIGS. 3 and 4 illustrate some examples of the concept of modifying volatility based on one or more volatility modification values or combinations of volatility modification values associated with virtual assets. Referring to FIG. 3, a third characteristic 323 of the red house 316 includes a volatility modification value ("+2") that the system can utilize to modify a volatility of a wagering game. In some embodiments, the volatility modification value 333 can be enhanced, or increased when used in combination with other virtual assets that have other volatility modification values. For example, the volatility modification value 333 increases by a factor of 2 when another red object (e.g., a red hotel, such as red hotel 317) is placed on a virtual real-estate property of a certain type (e.g., when placed on a "blue" type of property according to the Monopoly® game board, such as Boardwalk or Park Place, represented by the virtual real-estate properties 314 and 315). Other virtual assets besides virtual real-estate properties or structures (e.g., houses, hotels, etc.) on the properties can have modification values assigned, such as secondary-bonus-feature modification values or volatility modification values. In FIG. 4, an account profile 402 (e.g., for the player Bob S.) indicates non-wagering game account properties associated with virtual assets obtained by the player. For example, the player's type of town (e.g., a "forest" type of town) may have a given volatility modification value 404 assigned to it. A table 406 associated with a virtual real-estate property (i.e., with the "Boardwalk" property) includes modification values, such as a bonus game type modification value 408 that is associated with a type of terrain (e.g., a "rocky" terrain) for the virtual real-estate property, or a volatility modification value 410 associated with a type of color (e.g., "blue") for the virtual real-estate property. A table 412 is associated with a type of structure on the virtual real-estate property (e.g., a red house, such as the red house 316 described in FIG. 3). The table 412 includes sub-tables 414 and 416, which are related to types of bonus games. Depending on the type of bonus game that is being played during a wagering game session (e.g., assuming, only for sake of brevity, that the bonus game is limited to either a "free spin" type of bonus game or a "picking" type of bonus game), the system will refer to either the sub-table 414 or the sub-table 416 depending on which type of bonus game appears during the wagering game session. The sub-tables 414 and 416 include modification values that relate to secondary game features (e.g. multipliers, wild reels, sticky wilds, etc.) as well as to volatility. A table 418 stores similar types of data for all types of virtual real-estate properties, utility companies, and railroads owned by the player. The table 406 is only one of the tables depicted in FIG. 4 for a virtual real-estate property. Other tables exist for other virtual assets even though they are not depicted in FIG. 4. A table 422 stores information, such as modification values, that relate to other objects, such as virtual assets stored within a player inventory. For example, referring briefly back to FIG. 3, a player inventory shows specific objects 331, 332, and 332, which belong to, or were lent to, the player. For example, object 331 refers to a player's game piece, object 332 refers to a game card obtained during play of the non-wagering game, and object 333 refers to a virtual asset that was loaned to the player. The table 422, in FIG. 4, can include descriptions of characteristics related to the objects 331, 332, and 333. For instance, a table 422 includes a volatility modification value 424 associated with a type of color ("blue") assigned to the "blue diamond cane" virtual asset represented by object 333. The table 422 also includes a presentation modification value 425 that indicates a type of presentation to be used during a wagering game when presenting certain wagering game content. For instance, the presentation modification value 425 indicates that because of the existence of the blue diamond cane in the player's inventory, and because the blue diamond cane has a "smooth" texture type, then when a wagering game is presented, a Monopoly® character with formal attire will be used to make the presentation of certain the wagering game events. For instance, if a player wins an amount of money in the wagering game, Mr. Monopoly may appear in his top hat.

In some embodiments, as described previously, the system can combine modification values from one or more virtual asset tables. For example a wagering game may have an average payout of "5" credits. The average payout range may have a low end payout value of "3" credits and a high end value of "10" credits. Thus, the average, or default, volatility range for the wagering game is "3-10" credits. Based on the virtual assets described in FIGS. 3 and 4, however, the volatility high end may increase from the value of the "10" credits value to a higher value, such as "320" credits. For instance, the volatility modification value for a red house (e.g., "+2") combined with a volatility value for a red hotel with two levels (e.g., "+10) results in a combined volatility modification value of "+12." A characteristic of the red house causes the combined volatility modification value to increase 2× to "+24." Further, volatility modification values for the Boardwalk property (e.g., "+2"), the town (e.g., "+2") and the blue diamond cane (e.g., "+2) causes the high-end for the volatility to increase to "+30", which when added to the default high end of "10" credits raises a potential high end value to "40" credits. A combined modification value for a multiplier (e.g., a "+3" multiplier modification value for a red house, plus a "+2" multiplier modification value for a red hotel with two levels, plus a default multiplier of "3×") can result in a multiplier of "8×." Therefore, the high end volatility value can be "40" credits times the 8× multiplier, for a value of "320." The low end for the volatility can also decrease proportionally to a little as a value of "0" and/or can be weighted more heavily in likelihood to be a lower value as the high-end value increases.

The description of flow 200 continues at processing block 212, where the system selects the non-wagering game player account as one of a plurality of participants in a wagering game community event based on the one or more virtual assets. In some embodiments, the participants are selected based on a common item held by all players (e.g., all players who own the "Get out of jail" Community chest card, all players who own Zeus' scepter, etc.). In some embodiments, the system can group together virtual assets within a virtual world for non-wagering game player accounts that are logged in to a non-wagering game (e.g., group together Monopoly® towns, or similar types of domains, within a virtual world). The system can randomly select an area of the virtual world that includes the grouped together virtual assets (e.g., grouped domains that are grouped to appear near, or adjacent, to each other within the virtual world). The system can select the non-wagering game player accounts as the participants in the wagering game community event based on the location of the one or more virtual assets being in the area of the virtual world that was selected. In some embodiments, the system can also group together graphical representations of the domains via a map of the virtual world. In the map, the graphical representations can be depicted as being adjacent to each other.

Figure 5:
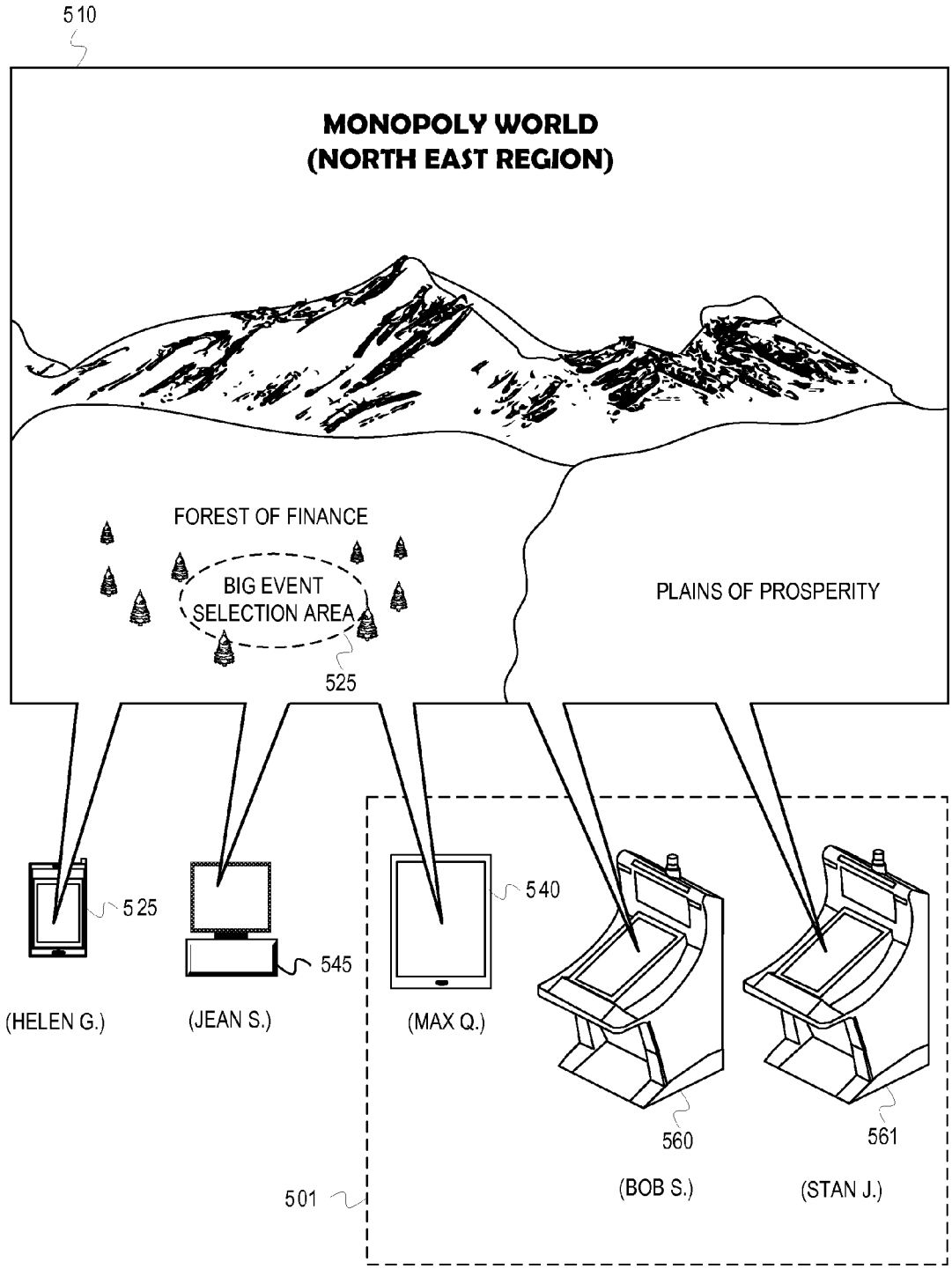
FIG. 5 is an illustration of selecting participants for a community wagering game event based on a location of one or more virtual assets in a simulated game environment, according to some embodiments.
Figure 6A:
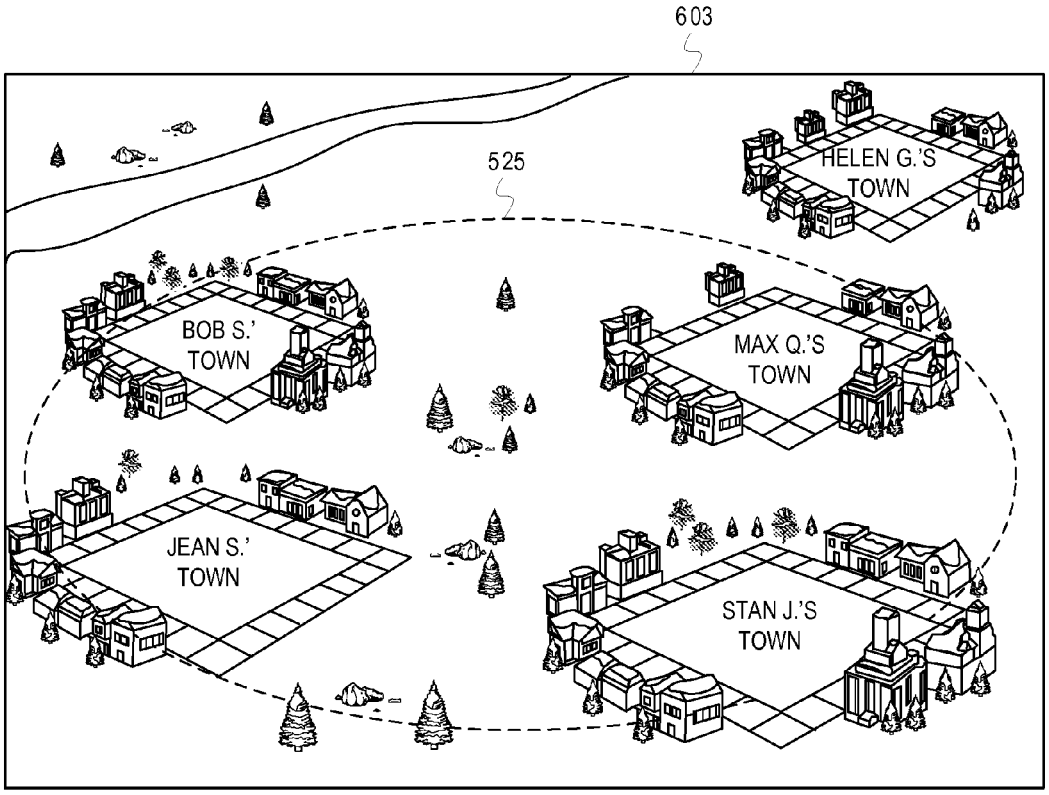
FIGS. 6A-6B are illustrations of organizing a location of non-wagering game virtual assets in a simulated game environment for inclusion in a community wagering game, according to some embodiments.
Figure 6B:
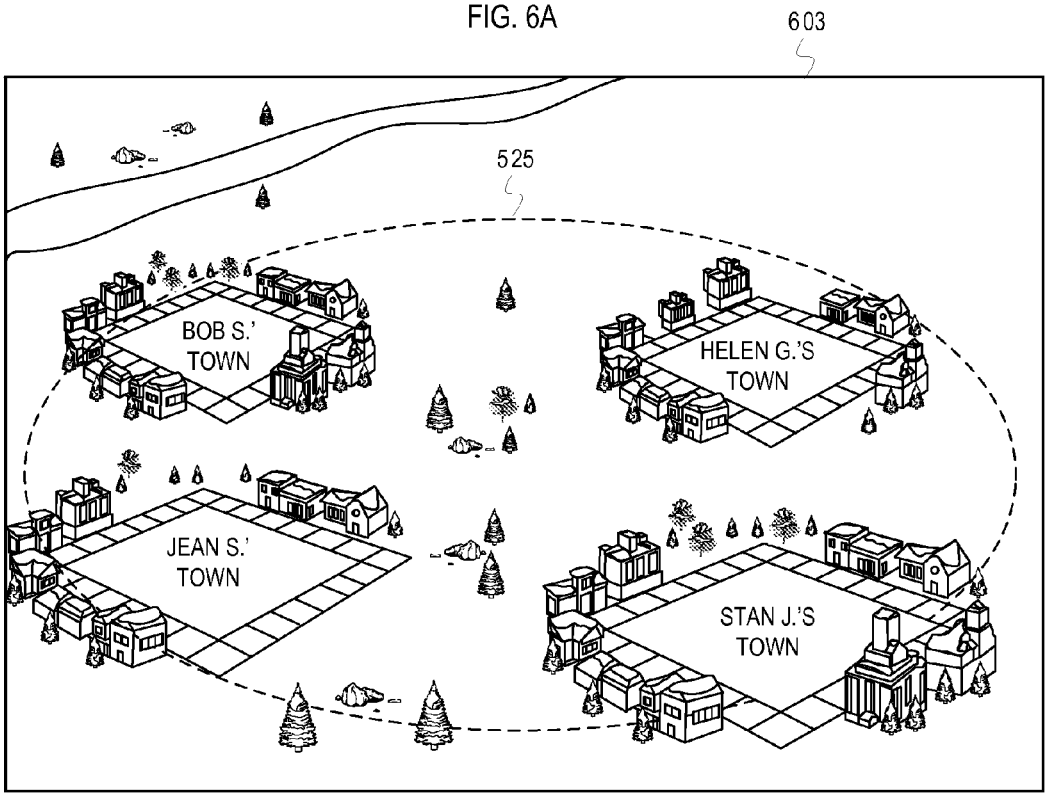

FIGS. 5 and 6A-6B illustrate an example of selecting participants for a community wagering game event and presenting domains for the players within a geographic location of a virtual world. For instance, in FIG. 5, a plurality of players are logged on to a non-wagering game 510 via computing devices. A first player, "Helen G." is logged on to the non-wagering game 510 via a mobile device 525. A second player, "Jean S." is logged on to the non-wagering game 510 via a personal computer 545. A third player, "Max Q." is logged on to the non-wagering game 510 via a tablet computer 540. A fourth player, "Bob S." is logged on to the non-wagering game 510 via a wagering game machine 560. A fifth player, "Stan J." is logged on to the non-wagering game 510 via another wagering game machine 561. The tablet computer 540, and wagering game machines 560 and 561 are in a casino 501. In some embodiments, Max Q., Bob S. and Stan J. are engaged in wagering game activity during one or more wagering game sessions while concurrently being logged in to the non-wagering game 510. The computing devices present a representation of at least a portion of the virtual world for the non-wagering game 510. The system can select an area 525 within a location of the virtual world. The area 525 is selected to choose a number of Monopoly® towns that are associated with a number of players whose towns are within the area 525. In some embodiments, as depicted in FIGS. 6A-6B, each player may possess a specific "town" or area within the larger virtual world. For example, the player "Bob S." may own "Bob S.'s Monopoly® town" which is geographically adjacent, within the Monopoly® virtual world, to Jean S.'s town, Max Q.'s town, and Stan J.'s town on a map 603 of a portion of the Monopoly® virtual world. The area 525, in FIG. 6A encloses Bob S.'s town, Max Q.'s town, Jean S.'s town and Stan J.'s town. Helen G.'s town is outside of the area 525. The area 525 may not be revealed yet to the players, but may be an intended selection area from which to select participants for a community wagering game event (i.e., a "Big Event") scheduled for a later time. Therefore, Max Q., Stan J., Bob S., and Jean S., may be intended to be selected as participants in the community gaming event, whereas Helen G. would not be intended to be selected because her town is outside of the area 525. Before the system reveals the area 525 via the map 603 and/or before the system selects participants for the community gaming event, Max Q. logs out of the tablet computer 540. As a result, as shown in FIG. 6B, the system removes Max Q.'s town from the map 603 and snaps in Helen G.'s town to the location where Max Q.'s town was previously. In some embodiments, the specific towns may snap together and form a geographic map of the virtual world only if the players are engaged in gambling activity associated with a gaming venue (e.g., only if the players are logged on to a wagering game machine or are involved in a wagering game session within a casino). In other embodiments, the towns may snap together and be selected regardless of whether some of the players are engaged in wagering game activity or are participating in a wagering game session. For instance, players who are logged on to a non-wagering game venue (e.g., a non-wagering game website, a social networking website, etc.) would be as eligible for the community gaming event as players logged in to wagering game machines in a casino. In other words, all of the players logged in to their respective forums may be eligible for the community gaming event. In some embodiments, during the community gaming event, the system can may some participants eligible for cash award and other non-eligible for cash award. For example, cash awards may be available for participants of the community gaming event that are logged in to a wagering game machine or computing device that presents wagering games. For the same community gaming event, non-cash awards (e.g., virtual currency of the non-wagering game) are available to those of the participants who are not engaged in wagering game activity. In some embodiments, players who are eligible for cash awards may also be eligible for non-cash awards. FIG. 7 illustrates an example. In FIG. 7, results 705 of a community gaming event are posted. Some players, such as Stan J. and Bob S., were eligible for, and received, cash awards. They also received other awards, some of which are non-cash awards, such as virtual currency or virtual assets, while some of the other awards are not cash awards but are related to wagering games, such as opportunities to use wagering features, free spins of a wagering game, and so forth. Some players, such as Helen G. and Jean S., who are not eligible for cash awards, won non-cash awards, as well as other awards, some of which are related to wagering games, such as a free spin or an invitation to enter a wagering game tournament.

Example Operating Environments

This section describes example operating environments, systems, networks, etc. and presents structural aspects of some embodiments.

Wagering Game System Architecture

Figure 8:
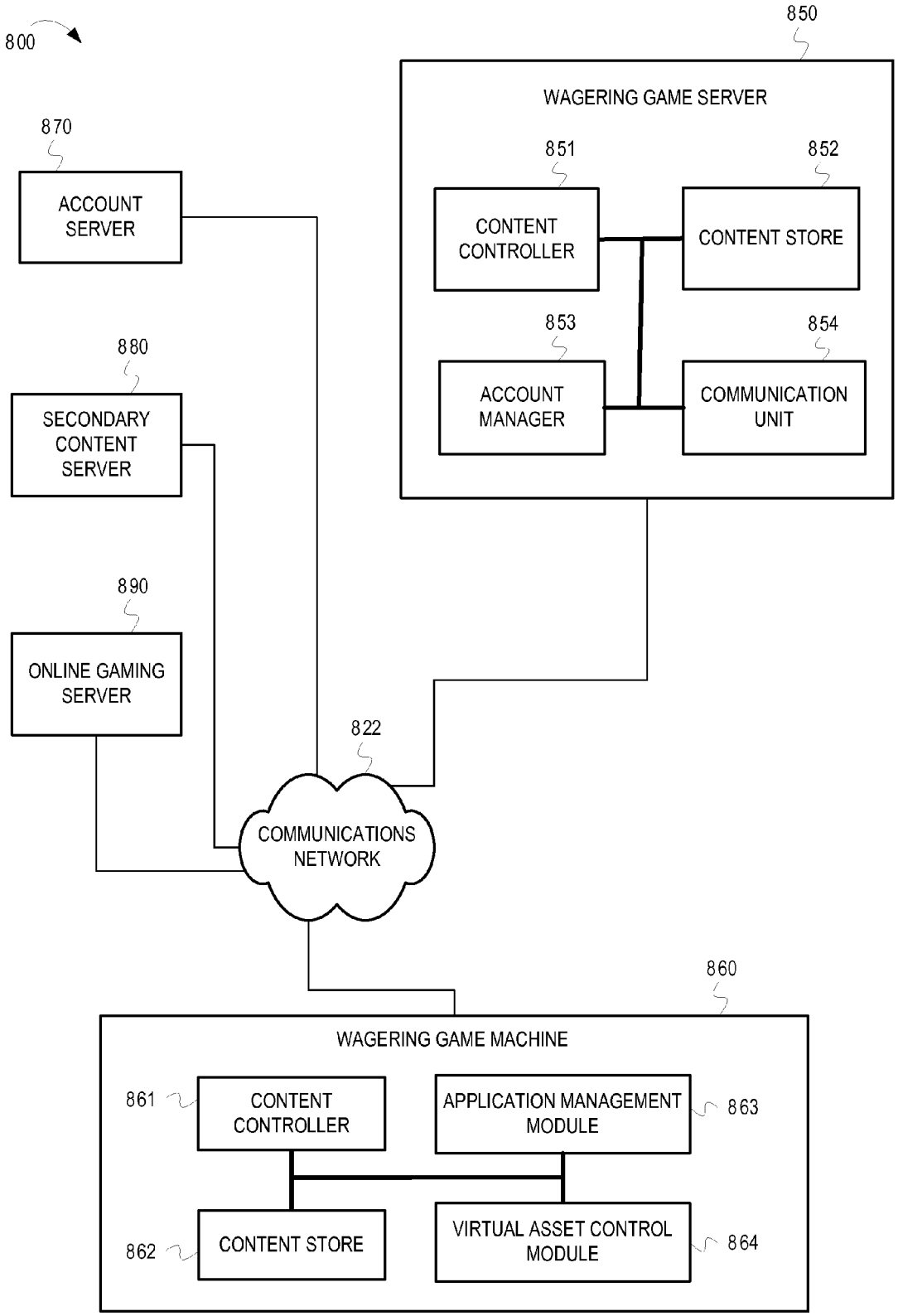
FIG. 8 is an illustration of a wagering game system architecture 800, according to some embodiments.

FIG. 8 is a conceptual diagram that illustrates an example of a wagering game system architecture 800, according to some embodiments. The wagering game system architecture 800 can include an account server 870 configured to control user related accounts accessible via wagering game networks and social networking networks. The account server 870 can store wagering game player account information, such as account settings (e.g., settings related to non-wagering games, settings related to social contacts, etc.), preferences (e.g., player preferences for virtual assets), player profile data (e.g., name, avatar, screen name, inventory, etc.), and other information for a player's account (e.g., financial information, account identification numbers, virtual assets, social contact information, etc.). The account server 870 can contain lists of social contacts referenced by a player account. The account server 870 can also provide auditing capabilities, according to regulatory rules. The account server 870 can also track performance of players, machines, and servers.

The wagering game system architecture 800 can also include a wagering game server 850 configured to control wagering game content, provide random numbers, and communicate wagering game information, account information, and other information to and from the wagering game machine 860. The wagering game server 850 can include a content controller 851 configured to manage and control content for presentation on the wagering game machine 860. For example, the content controller 851 can generate game results (e.g., win/loss values), including win amounts, for games played on the wagering game machine 860. The content controller 851 can communicate the game results to the wagering game machine 860. The content controller 851 can also generate random numbers and provide them to the wagering game machine 860 so that the wagering game machine 860 can generate game results. The wagering game server 850 can also include a content store 852 configured to contain content to present on the wagering game machine 860. The wagering game server 850 can also include an account manager 853 configured to control information related to player accounts.

For example, the account manager 853 can communicate wager amounts, game results amounts (e.g., win amounts), bonus game amounts, etc., to the account server 870. The wagering game server 850 can also include a communication unit 854 configured to communicate information to the wagering game machine 860 and to communicate with other systems, devices and networks.

The wagering game system architecture 800 can also include a wagering game machine 860 configured to present wagering games and receive and transmit information to coordinate, present, and control presentation of wagering game and non-wagering games according to some embodiments. The wagering game machine 860 can include a content controller 861 configured to manage and control content and presentation of content on the wagering game machine 860. The wagering game machine 860 can also include a content store 862 configured to contain content to present on the wagering game machine 860. The wagering game machine 860 can also include an application management module 863 configured to manage multiple instances of gaming applications. For example, the application management module 863 can be configured to launch, load, unload and control applications and instances of applications. The application management module 863 can launch different software players (e.g., a Microsoft® Silverlight™ Player, an Adobe® Flash® Player, etc.) and manage, coordinate, and prioritize what the software players do. The application management module 863 can also coordinate instances of the server applications in addition to local copies of applications. The application management module 863 can control window locations on a wagering game screen or display for the multiple gaming applications. In some embodiments, the application management module 863 can manage window locations on multiple displays including displays on devices associated with and/or external to the wagering game machine 860 (e.g., a top display and a bottom display on the wagering game machine 860, a peripheral device connected to the wagering game machine 860, a mobile device connected to the wagering game machine 860, etc.). The application management module 863 can manage priority or precedence of client applications that compete for the same display area. For instance, the application management module 863 can determine each client application's precedence. The precedence may be static (i.e. set only when the client application first launches or connects) or dynamic. The applications may provide precedence values to the application management module 863, which the application management module 863 can use to establish order and priority. The precedence, or priority, values can be related to tilt events, administrative events, primary game events (e.g., hierarchical, levels, etc.), secondary game events, local bonus game events, advertising events, etc. As each client application runs, it can also inform the application management module 863 of its current presentation state. The applications may provide presentation state values to the application management module 863, which the application management module 863 can use to evaluate and assess priority. Examples of presentation states may include celebration states (e.g., indicates that client application is currently running a win celebration), playing states (e.g., indicates that the client application is currently playing), game starting states (e.g., indicates that the client application is showing an invitation or indication that a game is about to start), status update states (e.g., indicates that the client application is not 'playing' but has a change of status that should be annunciated, such as a change in progressive meter values or a change in a bonus game multiplier), idle states (e.g., indicates that the client application is idle), etc. In some embodiments, the application management module 863 can be pre-configurable. The system can provide controls and interfaces for operators to control screen layouts and other presentation features for the configuring the application management module 863. The application management module 863 can communicate with, and/or be a communication mechanism for, a base game stored on a wagering game machine. For example, the application management module 863 can communicate events from the base game such as the base game state, pay line status, bet amount status, etc. The application management module 863 can also provide events that assist and/or restrict the base game, such as providing bet amounts from secondary gaming applications, inhibiting play based on gaming event priority, etc. The application management module 863 can also communicate some (or all) financial information between the base game and other applications including amounts wagered, amounts won, base game outcomes, etc. The application management module 863 can also communicate pay table information such as possible outcomes, bonus frequency, etc.

In some embodiments, the application management module 863 can control different types of applications. For example, the application management module 863 can perform rendering operations for presenting applications of varying platforms, formats, environments, programming languages, etc. For example, the application management module 863 can be written in one programming language format (e.g., JavaScript, Java, C++, etc.) but can manage, and communicate data from, applications that are written in other programming languages or that communicate in different data formats (e.g., Adobe® Flash®, Microsoft® Silverlight™, Adobe® Air™, hyper-text markup language, etc.). The application management module 863 can include a portable virtual machine capable of generating and executing code for the varying platforms, formats, environments, programming languages, etc. The application management module 863 can enable many-to-many messaging distribution and can enable the multiple applications to communicate with each other in a cross-manufacturer environment at the client application level. For example, multiple gaming applications on a wagering game machine may need to coordinate many different types of gaming and casino services events (e.g., financial or account access to run spins on the base game and/or run side bets, transacting drink orders, tracking player history and player loyalty points, etc.).

The wagering game machine 860 can also include a virtual asset control module 864 configured to control presentation of wagering games and non-wagering games and present wagering games according to virtual assets of a non-wagering game.

The wagering game system architecture 800 can also include a secondary content server 880 configured to provide content and control information for secondary games and other secondary content available on a wagering game network (e.g., secondary wagering game content, promotions content, advertising content, player tracking content, web content, etc.). The secondary content server 880 can provide "secondary" content, or content for "secondary" games presented on the wagering game machine 860. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content can be in one or more different formats, such as Adobe® Flash®, Microsoft® Silverlight™, Adobe® Air™, hyper-text markup language, etc. In some embodiments, the secondary content server 880 can provide and control content for community games, including networked games, social games, competitive games, or any other game that multiple players can participate in at the same time. In some embodiments, the secondary content server 880 can control and present an online website that hosts wagering games. The secondary content server 880 can also be configured to present multiple wagering game applications on the wagering game machine 860 via a wagering game website, or other gaming-type venue accessible via the Internet. The secondary content server 880 can host an online wagering website and/or a social networking website. The secondary content server 880 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The secondary content server 880 can be configured to integrate wagering games and non-wagering games. In some embodiments, the secondary content server 880 can also host social networking accounts, provide social networking content, control social networking communications, store associated social contacts, etc. The secondary content server 880 can also provide chat functionality for a social networking website, a chat application, or any other social networking communications mechanism. In some embodiments, the secondary content server 880 can utilize player data to determine marketing promotions that may be of interest to a player account. The secondary content server 880 can also analyze player data and generate analytics for players, group players into demographics, integrate with third party marketing services and devices, etc. The secondary content server 880 can also provide player data to third parties that can use the player data for marketing.

The wagering game system architecture 800 can also include an online gaming server 890 configured to control and present an online website that hosts wagering games. The online gaming server 890 can also be configured to present multiple wagering game applications on the wagering game machine 860, on a mobile computing device, on a personal computer, etc. via a wagering game website, or other gaming-type venue accessible via the Internet. The online gaming server 890 can host an online wagering website and/or a social networking website. The online gaming server 890 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.).

Each component shown in the wagering game system architecture 800 is shown as a separate and distinct element connected via a communications network 822. However, some functions performed by one component could be performed by other components. For example, the wagering game server 850 can also be configured to perform functions of the application management module 863, the virtual asset control module 864, the secondary content server 880, the account server 870, the web server 890, and other network elements and/or system devices. Furthermore, the components shown may all be contained in one device, but some, or all, may be included in, or performed by, multiple devices, as in the configurations shown in FIG. 8 or other configurations not shown. For example, the account manager 853 and the communication unit 854 can be included in the wagering game machine 860 instead of, or in addition to, being a part of the wagering game server 850. Further, in some embodiments, the wagering game machine 860 can determine wagering game outcomes, generate random numbers, etc. instead of, or in addition to, the wagering game server 850.

The wagering game machines described herein (e.g., wagering game machine 860) can take any suitable form, such as floor standing models, handheld mobile units, bar-top models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 800 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Wagering Game Machine Architecture

Figure 9:
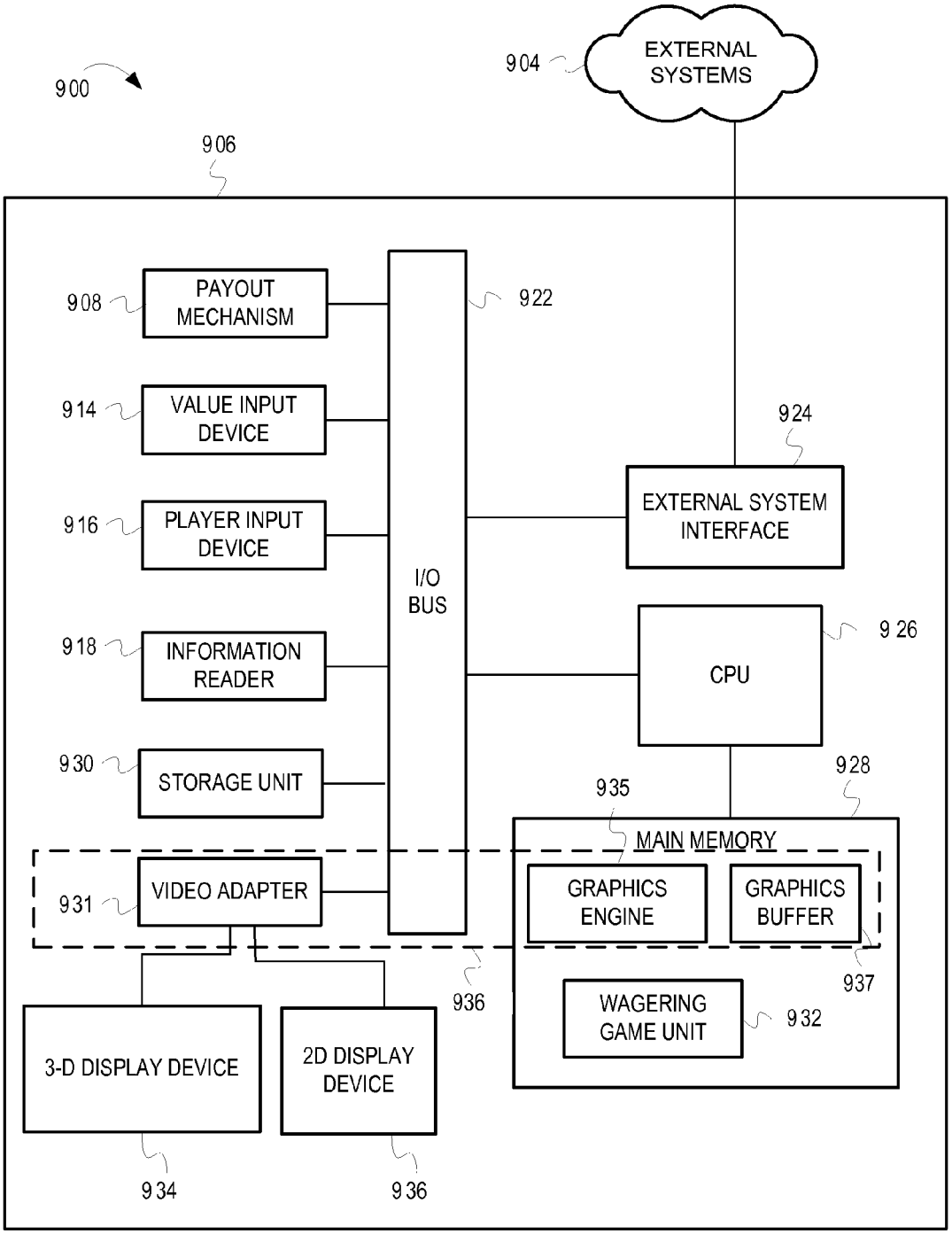
FIG. 9 is an illustration of a wagering game machine architecture 900, according to some embodiments.

FIG. 9 is a block diagram illustrating a wagering game machine architecture, according to example embodiments of the invention. As shown in FIG. 9, the wagering game machine architecture 900 includes a wagering game machine 906, which includes a central processing unit (CPU) 926 connected to main memory 928. The CPU 926 can include one or more processors, such as one or more Intel® Pentium processors, Intel® Core 2 Duo processors, AMD Opteron™ processors, UltraSPARC processors, etc. The main memory 928 includes a wagering game unit 932. In one embodiment, the wagering game unit 932 can present wagering games, such as video poker, video black jack, video slots, video lottery, etc., in whole or part.

The main memory 928 also includes a graphics engine 935 that can use stereoscopic 3D graphics and 2D graphics to present composite images that include multiple views of a virtual 3D wagering game environment. The graphics engine 935 can operate in concert with a video adapter 931 and graphics buffer 937, which together make up a graphics unit 936. The graphics unit 936 can present composite images on a 3D display device 934 and/or on a 2D display device 936. The video adapter 931 is also connected to the 2D display device 936.

The CPU 926 is also connected to an input/output (I/O) bus 922, which can include any suitable bus technologies, such as an AGTL+ frontside bus and a PCI backside bus. The I/O bus 922 is connected to a payout mechanism 908, value input device 914, player input device 916, information reader 918, storage unit 930, and the video adapter 931. The player input device 916 can include the value input device 914 to the extent the player input device 916 is used to place wagers. The I/O bus 922 is also connected to an external system interface 924, which is connected to external systems 904 (e.g., wagering game networks).

In one embodiment, the wagering game machine 906 can include additional peripheral devices and/or more than one of each component shown in FIG. 9. For example, in one embodiment, the wagering game machine 906 can include multiple external system interfaces 924 and/or multiple CPUs 926. In one embodiment, any of the components can be integrated or subdivided.

Furthermore, any component of the wagering game machine 906 can include hardware, firmware, and/or machine-readable storage media including instructions for performing the operations described herein.

Wagering Game Machine

Figure 10:
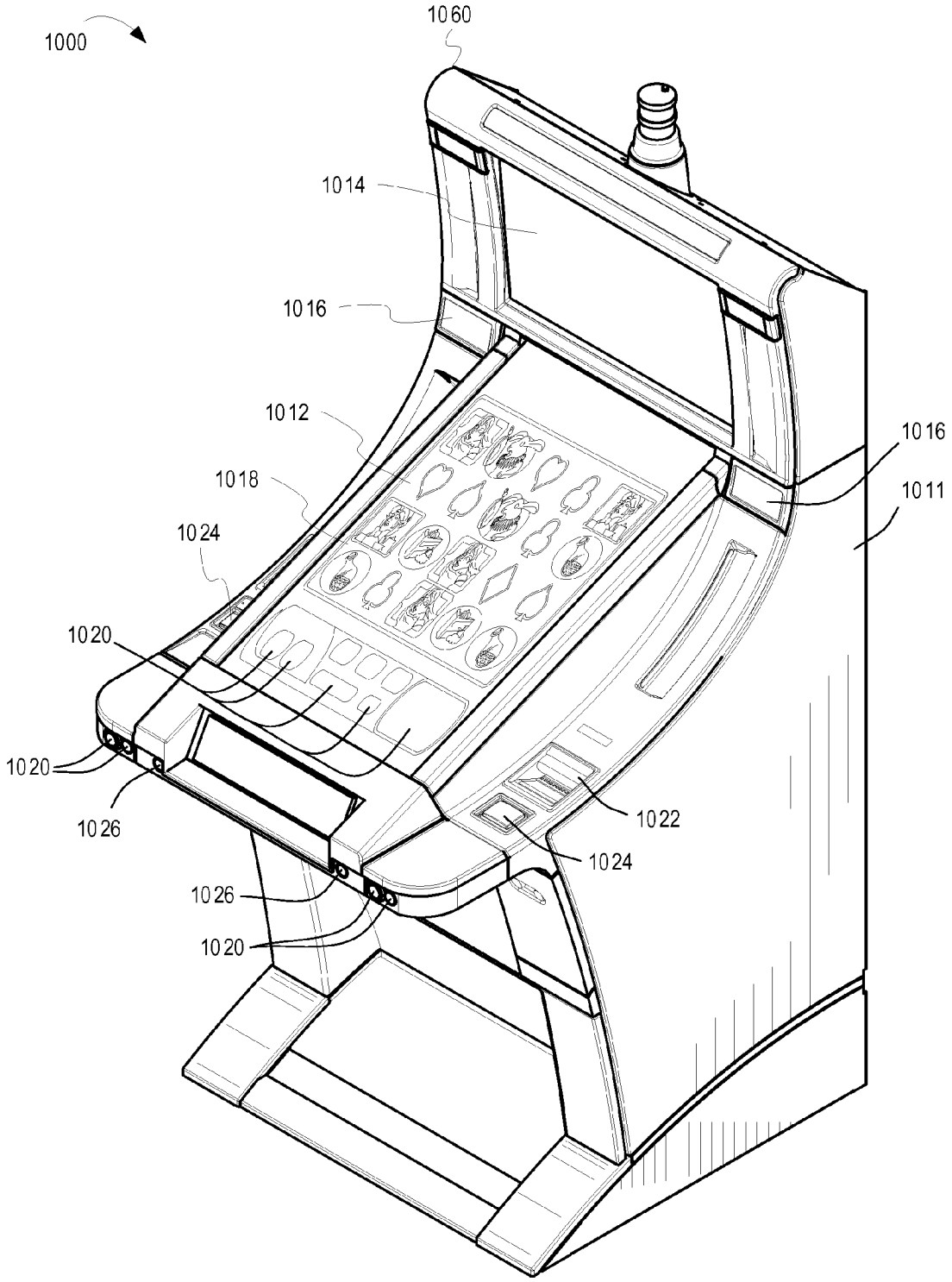
FIG. 10 is an illustration of a wagering game machine 1000, according to some embodiments.

FIG. 10 is a conceptual diagram that illustrates an example of a wagering game system 1000, according to some embodiments. In FIG. 10, the wagering game system 1000 includes a wagering game machine 1060 similar to those used in gaming establishments, such as casinos. The wagering game machine 1060 may, in some examples, be referred to as a gaming terminal or an electronic gaming machine. The wagering game machine 1060 may have varying structures and methods of operation. For example, the wagering game machine 1060 may include electromechanical components configured to play mechanical slots. In another example, the 1060 includes electronic components configured to play a video casino game, such as slots, keno, poker, blackjack, roulette, craps, etc. The wagering game machine 1060 is depicted as a floor-standing model. However, other examples of wagering game machines include handheld mobile units, bartop models, workstation-type console models, etc. Further, the wagering game machine 1060 may be primarily dedicated for use in conducting wagering games, or may include non-dedicated devices, such as mobile phones, personal digital assistants, personal computers, etc. Exemplary types of wagering game machines are disclosed in U.S. Pat. No. 6,517,433 and Patent Application Publication Nos. US2010/0062196 and US2010/0234099, which are incorporated herein by reference in their entireties.

The wagering game machine 1060 illustrated in FIG. 10 comprises a cabinet 1011 that may house various input devices, output devices, and input/output devices. By way of example, the wagering game machine 1060 includes a primary display area 1012, a secondary display area 1014, and one or more audio speakers 1016. The primary display area 1012 or the secondary display area 1014 may include one or more of a cathode ray tube (CRT), a high resolution liquid crystal display (LCD), a plasma display, a light emitting diode (LED) display, a three-dimensional (3D) display, a video display, or a combination thereof. In some examples, the primary display area 1012 or the secondary display area 1014 includes mechanical reels to display a wagering game outcome. In some example, the primary display area 1012 or the secondary display area 1014 present a transmissive video display disposed in front of a mechanical-reel display to portray a video image superimposed upon the mechanical-reel display. In FIG. 10, the wagering game machine 1060 is a "slant-top" version in which the primary display 1012 is slanted (e.g., at about a thirty-degree angle toward the player of the wagering game machine 1060). Another example of wagering game machine 1060 is an "upright" version in which the primary display 1014 is oriented vertically relative to the player. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the wagering game machine 1060. The wagering game machine 1060 includes a touch screen(s) 1018 mounted over the primary or secondary areas, buttons 1020 on a button panel, bill validator 1022, information reader/writer(s) 1024, and player-accessible port(s) 1026 (e.g., audio output jack for headphones, video headset jack, USB port, wireless transmitter/receiver, etc.). It should be understood that numerous other peripheral devices and other elements exist and are readily utilizable in any number of combinations to create various forms of a wagering game machine in accord with the present concepts.

Input devices, such as the touch screen 1018, buttons 1020, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a gaming system, said method comprising:

initiating, via at least one electronic processing unit of the gaming system, a wagering game session, wherein the gaming system is configured to provide one or more casino wagering games for the wagering game session presented via the gaming system, and wherein the gaming system is configured to receive, via a value input device, physical money for placement of wagers for the one or more casino wagering games and provide wagering game outcomes based on the wagers;

connecting, via a communication network through a network communication interface of the gaming system, the gaming system to a server that hosts one or more player accounts;

during the wagering game session, electronically accessing from the server, via the network communication interface, account data from an inventory of a player account for a persistent-state social-network game associated with the player account;

analyzing, by an electronic processing unit of the gaming system in response to electronically accessing the server, a first graphical characteristic of a first virtual object stored in the inventory, wherein the first virtual object is from the persistent-state social-network game, wherein the first virtual object is attained at least via play of the persistent-state social-network game by the player account;

determining, based on the analyzing of the first graphical characteristic, a first degree to which the first graphical characteristic varies from a first baseline value for the persistent-state social-network game; and electronically modifying, in response to the analyzing the first graphical characteristic by the electronic processing unit, a volatility of payouts for at least one of the one or more casino wagering games proportional to the first degree to which the first graphical characteristic varies from the first baseline value.

2. The method of claim 1, wherein the first graphical characteristic of the persistent-state social-network game depends on one or more virtual assets attained via one or more of attainment and modification of one or more virtual objects of a simulated community environment, wherein the one or more virtual objects persist with the player account.

3. The method of claim 2, wherein the presenting the wagering game comprises modifying a volatility of the at least one of the one or more casino wagering games proportional to one or more values assigned to the one or more virtual assets.

4. The method of claim 3, wherein modifying the volatility comprises increasing a high end value and lowering a low end value of a volatility range.

5. The method of claim 1, wherein electronically modifying the volatility of payouts for the at least one of the one or more casino wagering games comprises one or more of modifying chances that a specific type of wagering game will be presented based on one or more characteristics of one or more virtual assets and using characteristics of one or more virtual assets to present wagering game content for the wagering game.

6. The method of claim 1 further comprising updating a state of the persistent-state social-network game based on play of the wagering game.

7. The method of claim 1, wherein the at least one of the one or more casino wagering games includes a community event in which a plurality of wagering game machines are eligible to participate, and further comprising presenting the community event via the plurality of wagering game machines based on a state of the persistent-state social-network game.

8. The method of claim 1, wherein the at least one of the one or more casino wagering games includes a community event in which a plurality of players are eligible to participate, and further comprising presenting the community event according to a state of the persistent-state social-network game for any one of the plurality of players.

9. The method of claim 1 further comprising:

determining, based on the analyzing the first graphical characteristic of the first virtual object, an achievement level in the persistent-state social-network game;

determining that a wagering game event occurs for the at least one of the one or more casino wagering games; and determining, based on analysis of the wagering game event and the first virtual object, that the first virtual object corresponds to a reward for the wagering game event, wherein the modifying the volatility of payouts proportional to the first degree to which the first graphical characteristic varies from the first baseline value comprises setting an award level for the reward proportional to the achievement level.

10. The method of claim 1, wherein the determining the first degree to which the first graphical characteristic varies from the first baseline value comprises determining a degree to which one or more of a terrain of the first virtual object varies from a baseline terrain for the persistent-state social-network game, a texture of the first virtual object varies from a baseline texture for the persistent-state social-network game, a shade of the first virtual object varies from a baseline shade for the persistent-state social-network game, a color of the first virtual object varies from a baseline color for the persistent-state social-network game, or a size of the first virtual object varies from a baseline size for the persistent-state social-network game.

11. The method of claim 1 further comprising:

analyzing a second characteristic of a second virtual object from the persistent-state social-network game;

determining, based on the analyzing of the second virtual object, a second degree to which the second characteristic varies from a second baseline value for the persistent-state social-network game; and combining the first degree with the second degree, wherein the modifying the volatility of payouts for the at least one of the one or more casino wagering games comprises modifying the volatility of payouts based on the combining the first degree with the second degree.

12. The method of claim 11, wherein the first virtual object is a different type of object from the second virtual object.

13. One or more non-transitory, machine-readable storage media having instructions stored thereon, which when executed by a set of one or more electronic processing units of a gaming system cause the set of one or more electronic processing units to perform operations comprising:

presenting, via an electronic display device of the gaming system, wagering game content for a casino wagering game during a wagering game session associated with a player account, wherein the gaming system is configured to receive, via a value input device, physical money for placement of wagers for the casino wagering game;

connecting, via a communication network through a network communication interface of the gaming system, the gaming system to a server that hosts the player account;

electronically accessing, from the server, via the network communication interface, account data from an inventory of the player account for a persistent-state, non-wagering game associated with the player account in response to presenting the wagering game content;

analyzing a graphical characteristic of a virtual object stored in the inventory, wherein the virtual object is from the persistent-state, non-wagering game referenced by the account data in response to accessing the persistent-state, non-wagering game;

determining, based on the analyzing of the graphical characteristic, a degree to which the graphical characteristic varies from a baseline value for the persistent-state, non-wagering game; and electronically modifying a volatility of payouts for the casino wagering game proportional to the degree to which the graphical characteristic varies from the baseline value in response to the electronically analyzing the graphical characteristic.

14. The one or more non-transitory, machine-readable storage media of claim 13, wherein the operation for electronically modifying the volatility of payouts for the casino wagering game includes operations comprising:

determining at least one volatility modification value assigned to at least one of one or more virtual assets associated with the graphical characteristic of the persistent-state, non-wagering game; and using the at least one volatility modification value to alter a range of potential payout values associated with an average payout for the casino wagering game based on the at least one volatility modification value.

15. The one or more non-transitory, machine-readable storage media of claim 14, wherein the operation for using the at least one volatility modification value to alter the range of potential payout values for the casino wagering game proportional to the at least one volatility modification value includes an operation comprising increasing a high-end value of the range of potential payout values proportional to the at least one volatility modification value and decreasing a low-end value of the range of potential payout values proportional to the at least one volatility modification value.

16. The one or more non-transitory, machine-readable storage media of claim 14, wherein the operation for using the at least one volatility modification value to alter the range of potential payout values for the casino wagering game proportional to the at least one volatility modification value includes an operation comprising decreasing a low-end value of the range of potential payout values.

17. The one or more non-transitory, machine-readable storage media of claim 13, wherein the operation for electronically modifying the volatility of payouts for the casino wagering game includes operations comprising:

accessing a plurality of tables associated with one or more virtual assets of the persistent-state, non-wagering game, wherein each of the plurality of tables include at least one modification value;

combining the at least one modification value from each of the plurality of tables; and modifying the virtual object based on a result of the combining of the at least one modification value from each of the plurality of tables.

18. A gaming system comprising:

at least one input device configured to receive an indication of a wager for at least one casino wagering game;

at least one electronic display device configured to display the at least one casino wagering game;

a network communication interface configured to connect to a communication network;

at least one electronic wagering game controller;

a value input device configured to receive physical money for placement of wagers for the at least one casino wagering game; and at least one memory device configured to store instructions which, when executed by the at least one electronic wagering game controller, cause the gaming system to present, via the at least one electronic display device, the at least one casino wagering game during a wagering game session associated with a wagering game player account, connect, via the network communication interface, the gaming system to a server that hosts a non-wagering game player account linked to the wagering game player account, electronically access from the server, via the network communication interface, account data from an inventory of the non-wagering game player account for a non-wagering game associated with the non-wagering game player account, present, concurrently with presentation of the at least one casino wagering game, the non-wagering game, electronically analyze, in response to electronically accessing the server, a graphical characteristic of a virtual asset of the non-wagering game referenced by the account data, determine, based on analysis of the graphical characteristic, a degree to which the graphical characteristic varies from a baseline value for the non-wagering game, and electronically modify, in response to the analyzing of the graphical characteristic, a volatility of the at least one casino wagering game proportional to the degree to which the graphical characteristic varies from the baseline value.

19. The gaming system of claim 18, wherein the at least one memory device configured to store instructions to electronically modify the volatility of the at least one casino wagering game is configured to store instructions, which when executed by the at least one electronic wagering game controller, cause the gaming system to determine a range of potential payout values associated with an average payout for the at least one casino wagering game, determine one or more volatility modification values associated with the virtual asset, and increase the range of potential payout values in accordance with the one or more volatility modification values.

20. The gaming system of claim 18, wherein the at least one memory device configured to store instructions to increase the range of potential payout values is configured to store instructions, which when executed by the at least one electronic wagering game controller, cause the gaming system to increase a high end value of the range of potential payout values proportional to the one or more volatility modification values, and decrease a low end value of the range of potential payout values proportional to the one or more volatility modification values.

21. The gaming system of claim 18, wherein the at least one memory device is configured to store instructions, which when executed by the at least one electronic wagering game controller, further cause the gaming system to search through a plurality of virtual assets that belong to the non-wagering game player account, determine, via the search, that at least one of the plurality of virtual assets, has at least one assigned volatility modification value, and use the at least one assigned volatility modification value to modify the volatility.

22. A wagering game machine comprising:

at least one input device configured to receive an indication of a wager for play of a casino wagering game;

at least one electronic display device configured to display the casino wagering game;

a network communication interface configured to connect to a communication network;

at least one electronic processing unit;

a value input device configured to receive physical money for placement of wagers for the casino wagering game; and at least one memory device configured to store instructions which, when executed by the at least one electronic processing unit, cause the wagering game machine to initiate a wagering game session associated with a player account for the casino wagering game, connect, via the network communication interface, the wagering game machine to a server that hosts one or more player accounts, electronically access, via the network communication interface, account data from an inventory of one of the one or more player accounts for a non-wagering game associated with the one of the one or more player accounts, analyze, in response to electronically accessing the server, a graphical characteristic of a virtual asset stored in the inventory, wherein the virtual asset is from the non-wagering game, which virtual asset is persistent with the non-wagering game, and wherein the virtual asset is attainable at least via play of the non-wagering game, determine, based on analysis of the virtual asset, a degree to which the graphical characteristic varies from a baseline value for the non-wagering game, and electronically modify, in response to the analysis of the graphical characteristic by the at least one electronic processing unit, a volatility of payouts for the casino wagering game proportional to the degree to which the graphical characteristic varies from the baseline value.

23. The wagering game machine of claim 22, wherein the at least one memory device is configured to store instructions which, when executed by the at least one electronic processing unit, cause the wagering game machine to:

detect that the graphical characteristic of the virtual asset indicates a first type of wagering game characteristic that is different from a second type of wagering game characteristic, wherein the casino wagering game is configured to present the second type of wagering game characteristic by default; and present the wagering game content with the first type of wagering game characteristic instead of the presenting the wagering game content with the second type of wagering game characteristic.

24. The wagering game machine of claim 22, wherein the at least one memory device configured is configured to store instructions which, when executed by the at least one electronic processing unit, further cause the wagering game machine to:

detect one or more modification values assigned to the graphical characteristic of the virtual asset; and modify a volatility of the casino wagering game using the one or more modification values.

25. The wagering game machine of claim 22, wherein the at least one memory device is configured to store instructions which, when executed by the at least one electronic processing unit, cause the wagering game machine to:

detect a wagering game outcome to be presented for the casino wagering game; and modify the wagering game outcome is based, at least in part, on the graphical characteristic of the virtual asset.

* * * * *